US009892682B2

(12) United States Patent
Pyo

(10) Patent No.: US 9,892,682 B2
(45) Date of Patent: Feb. 13, 2018

(54) ELECTROLUMINESCENT DISPLAY DEVICE FOR REDUCING COLOR DISTORTION OF LOW GRAY VALUES AND METHOD OF OPERATING SAME

(71) Applicant: Samsung Display Co., LTD., Yongin-si, Gyeonggi-Do (KR)

(72) Inventor: Si-Beak Pyo, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 52 days.

(21) Appl. No.: 14/992,447

(22) Filed: Jan. 11, 2016

(65) Prior Publication Data

US 2016/0365024 A1 Dec. 15, 2016

(30) Foreign Application Priority Data

Jun. 15, 2015 (KR) ..... 10-2015-0084503

(51) Int. Cl.
*G09G 5/10* (2006.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01); *G09G 2300/0842* (2013.01); *G09G 2300/0861* (2013.01); *G09G 2320/0242* (2013.01); *G09G 2320/0276* (2013.01); *G09G 2320/0666* (2013.01); *G09G 2320/0673* (2013.01)

(58) Field of Classification Search
CPC ..... G09G 3/3233
USPC ..... 345/690–691
See application file for complete search history.

(56) References Cited

U.S. PATENT DOCUMENTS

2012/0242710 A1* 9/2012 Kang ..... G09G 3/3208 345/690
2013/0135272 A1* 5/2013 Park ..... G09G 3/3233 345/211
2013/0169693 A1 7/2013 Pyo
2014/0184654 A1* 7/2014 Lee ..... G09G 3/3233 345/690
2014/0189444 A1* 7/2014 Kwon ..... G06F 11/0736 714/48

FOREIGN PATENT DOCUMENTS

KR 1020060122307 A 11/2006
KR 1020090062764 A 6/2009
(Continued)

*Primary Examiner* — Long D Pham
(74) *Attorney, Agent, or Firm* — Cantor Colburn LLP

(57) ABSTRACT

A first gamma offset corresponding to a first gamma reference voltage is determined by performing a multi-time programmable ("MTP") operation with respect to a first reference gray value, a second gamma offset corresponding to a second gamma reference voltage is determined by performing the MTP operation with respect to a second reference gray value greater than the first reference gray value, a base gamma offset is determined by performing the MTP operation with respect to a base reference gray value smaller than the first reference gray value. and low gray voltages corresponding to low gray values smaller than the first reference gray value are generated based on the base gamma offset, the first gamma offset and the second gamma offset.

20 Claims, 17 Drawing Sheets

(56) References Cited

FOREIGN PATENT DOCUMENTS

| | | | |
|---|---|---|---|
| KR | 1020100094815 | A | 8/2010 |
| KR | 1020140086174 | A | 7/2014 |
| KR | 1020140092502 | A | 7/2014 |
| KR | 1020150040095 | A | 4/2015 |

* cited by examiner

FIG. 7B

| GRAY VALUE | GRAY VOLTAGE |
|---|---|
| 0 | V0 |
| 1 | V11 + (V11-V23) * 10K/12 |
| 2 | V11 + (V11-V23) * 9K/12 |
| 3 | V11 + (V11-V23) * 8K/12 |
| 4 | V11 + (V11-V23) * 7K/12 |
| 5 | V11 + (V11-V23) * 6K/12 |
| 6 | V11 + (V11-V23) * 5K/12 |
| 7 | V11 + (V11-V23) * 4K/12 |
| 8 | V11 + (V11-V23) * 3K/12 |
| 9 | V11 + (V11-V23) * 2K/12 |
| 10 | V11 + (V11-V23) * K/12 |
| 11 | V11 |

FIG. 9B

| GRAY VALUE | GRAY VOLTAGE |
|---|---|
| 0 | V11 + (V11-V23) * 11K/12 |
| 1 | V11 + (V11-V23) * 10K/12 |
| 2 | V11 + (V11-V23) * 9K/12 |
| 3 | V11 + (V11-V23) * 8K/12 |
| 4 | V11 + (V11-V23) * 7K/12 |
| 5 | V11 + (V11-V23) * 6K/12 |
| 6 | V11 + (V11-V23) * 5K/12 |
| 7 | V11 + (V11-V23) * 4K/12 |
| 8 | V11 + (V11-V23) * 3K/12 |
| 9 | V11 + (V11-V23) * 2K/12 |
| 10 | V11 + (V11-V23) * K/12 |
| 11 | V11 |

FIG. 11

LUT

| | | | | |
|---|---|---|---|---|
| CASE1 | ROFSr1, GOFSr1, BOFSr1<br>RGRVr1, GGRVr1, BGRVr1 | ROFS11, GOFS11, BOFS11<br>RGRV11, GGRV11, BGRV11 | ... | ROFS81, GOFS81, BOFS81<br>RGRV81, GGRV81, BGRV81 |
| CASE2 | ROFSr2, GOFSr2, BOFSr2<br>RGRVr2, GGRVr2, BGRVr2 | ROFS12, GOFS12, BOFS12<br>RGRV12, GGRV12, BGRV12 | ... | ROFS82, GOFS82, BOFS82<br>RGRV82, GGRV82, BGRV82 |
| ⋮ | ⋮ | ⋮ | ⋰ | ⋮ |
| CASEk | ROFSrk, GOFSrk, BOFSrk<br>RGRVrk, GGRVrk, BGRVrk | ROFS1k, GOFS1k, BOFS1k<br>RGRV1k, GGRV1k, BGRV1k | ... | ROFS8k, GOFS8k, BOFS8k<br>RGRV8k, GGRV8k, BGRV8k |

ELECTROLUMINESCENT DISPLAY DEVICE FOR REDUCING COLOR DISTORTION OF LOW GRAY VALUES AND METHOD OF OPERATING SAME

This application claims priority to Korean Patent Application No. 10-2015-0084503 filed on Jun. 15, 2015, and all the benefits accruing therefrom under 35 U.S.C. § 119, the content of which in its entirety is herein incorporated by reference.

BACKGROUND

1. Field

Exemplary embodiments of the invention relate to a display device, and more particularly to an electroluminescent display device for reducing color distortion of low gray values and a method of operating the electroluminescent display device.

2. Discussion of the Related Art

Recently, various display devices such as a liquid crystal display ("LCD"), a plasma display, and an electroluminescent display have gained popularity. Particularly, the electroluminescent display can be driven with quick response speed and reduced power consumption, using a light-emitting diode ("LED") or an organic light-emitting diode ("OLED") that emits light through recombination of electrons and holes.

As the electroluminescent display device is manufactured, an image quality of an end product (i.e., complete product) of the electroluminescent display device may not reach a target quality level because of deviations in a manufacturing process. In this case, the end product may be determined as a defective product, and the defective product may be discarded. However, discarding all end products determined as defective products is not efficient. Therefore, a post-correction for adjusting the image quality of the organic light emitting display device to reach the target quality level is required. Thus, a multi-time programmable ("MTP") operation for repeatedly performing the post-correction in luminance and color coordinate for respective pixel circuits is performed in order to adjust the image quality of the electroluminescent display device to reach the target quality level.

The MTP operation may be performed by storing the respective gamma offsets based on comparison between a reference gamma curve and respective actual gamma curves that are generated based on a pixel gamma curve.

SUMMARY

It is difficult to implement a brightness of low gray values because a detecting device used in the manufacturing device has a limited sensitivity to the brightness. Accordingly color distortion of the low gray values may occur and thus the image quality of the display device may be degraded.

At least one exemplary embodiment of the invention provides a method of operating an electroluminescent display device capable of reducing color distortion of low gray values.

At least one exemplary embodiment of the invention provides an electroluminescent display device capable of reducing color distortion of low gray values.

According to exemplary embodiments, a method of operating an electroluminescent display device, includes, determining a first gamma offset corresponding to a first gamma reference voltage by performing a multi-time programmable ("MTP") operation with respect to a first reference gray value, determining a second gamma offset corresponding to a second gamma reference voltage by performing the MTP operation with respect to a second reference gray value greater than the first reference gray value, determining a base gamma offset by performing the MTP operation with respect to a base reference gray value smaller than the first reference gray value and generating low gray voltages corresponding to low gray values smaller than the first reference gray value based on the base gamma offset, the first gamma offset and the second gamma offset.

In an exemplary embodiment, generating the low gray voltages may include determining a slope factor representing a trend of the low gray voltages based on the base gamma offset, the first gamma offset and the second gamma offset.

In an exemplary embodiment, the low gray voltages may be determined by performing an extrapolation of the first gamma reference voltage and the second gamma reference voltage using the slope factor as a weight value.

In an exemplary embodiment, generating the low gray voltages may further include calculating a minimum gamma reference voltage corresponding to a minimum reference gray value smaller than the base reference gray value based on the slope factor, the first gamma reference voltage and the second gamma reference voltage.

In an exemplary embodiment, generating the low gray voltages may further include generating the minimum gamma reference voltage based on a minimum gamma offset corresponding to the calculated minimum gamma reference voltage, generating the first gamma reference voltage based on the first gamma offset and generating the low gray voltages corresponding to the low gray values between the minimum reference gray value and the first reference gray value by linearly dividing the minimum gamma reference voltage and the first gamma reference voltage.

In an exemplary embodiment, the minimum reference gray value may correspond to a gray value of 1.

In an exemplary embodiment, a gray voltage corresponding to a gray value of 0 may have a fixed voltage regardless of the MTP operation.

In an exemplary embodiment, the minimum reference gray value may correspond to a gray value of 0.

In an exemplary embodiment, the slope factor may include a red slope factor corresponding to red pixels, a green slope factor corresponding to green pixels and a blue slope factor corresponding to blue pixels.

In an exemplary embodiment, each of the red slope factor, the green slope factor and the blue slope factor may include a plurality of values corresponding to a plurality of temperature intervals.

In an exemplary embodiment, each of the red slope factor, the green slope factor and the blue slope factor may include a plurality of values corresponding to a plurality of dimming brightness intervals.

According to exemplary embodiments, an electroluminescent display device includes a display panel including a plurality of pixels connected to a plurality of data lines, a gamma circuit and a data driver. The gamma circuit stores a plurality of gamma offsets corresponding to a plurality of gamma reference voltages. The gamma offsets is determined by performing a MTP operation with respect to a plurality of reference gray values. The gamma circuit generates the gamma reference voltages based on the stored gamma offsets. The data driver generates a plurality of gray voltages based on the gamma reference voltages, and drives the data lines based on image data and the gray voltages. The electroluminescent display device generates low gray voltages corresponding to low gray values based on a first gamma offset corresponding to a first reference gray value, a second gamma offset corresponding to a second reference gray value greater than the first reference gray value and a base gamma offset corresponding to a base reference gray value smaller than the first reference gray value. The low gray values are smaller than the first reference gray value.

In an exemplary embodiment, the gamma circuit may include a storage unit which stores and provides the base gamma offset, the first gamma offset and the second gamma offset, a calculation unit and a voltage generation block. The calculation unit may determine a slope factor based on the base gamma offset, the first gamma offset and the second gamma offset, where the slope factor represents a trend of the low gray voltages corresponding to the low gray values. The calculation unit may calculate a minimum gamma reference voltage corresponding to a minimum reference gray value smaller than the base reference gray value based on the slope factor, a first gamma reference voltage corresponding to the first gamma offset and a second gamma reference voltage corresponding to the second gamma offset, and may provide a minimum gamma offset corresponding to the calculated minimum gamma reference voltage. The voltage generation block may generate the minimum gamma reference voltage, the first gamma reference voltage and the second gamma reference voltage based on the minimum gamma offset, the first gamma offset and the second gamma offset.

In an exemplary embodiment, the data driver may generate the low gray voltages corresponding to the low gray values between the minimum reference gray value and the first reference gray value by linearly dividing the minimum gamma reference voltage and the first gamma reference voltage.

In an exemplary embodiment, the minimum reference gray value may correspond to a gray value of 1.

In an exemplary embodiment, a gray voltage corresponding to a gray value of 0 may have a fixed voltage regardless of the MTP operation.

In an exemplary embodiment, the minimum reference gray value may correspond to a gray value of 0.

In an exemplary embodiment, the slope factor may include a red slope factor corresponding to red pixels, a green slope factor corresponding to green pixels and a blue slope factor corresponding to blue pixels.

In an exemplary embodiment, each of the red slope factor, the green slope factor and the blue slope factor may include a plurality of values corresponding to a plurality of temperature intervals.

In an exemplary embodiment, each of the red slope factor, the green slope factor and the blue slope factor may include a plurality of values corresponding to a plurality of dimming brightness intervals.

The electroluminescent display device and the method of operating the electroluminescent display device according to exemplary embodiments may reduce color distortion of low gray values and enhance image quality of the electroluminescent display device by determining the slope factor representing trend of the low gray voltages based on the base gamma offset that is obtained through the MTP operation and by generating the low gray voltages based on the slope factor.

BRIEF DESCRIPTION OF THE DRAWINGS

Exemplary embodiments of the invention will be more clearly understood from the following detailed description taken in conjunction with the accompanying drawings.

FIGS. 7A and 7B are diagrams for describing an operation of the gamma circuit of FIG. 6.

FIGS. 9A and 9B are diagrams for describing an operation of the gamma circuit of FIG. 8.

FIG. 11 is a diagram illustrating an example mapping relation between gamma offsets and gamma reference voltages.

DETAILED DESCRIPTION

Figure 1:
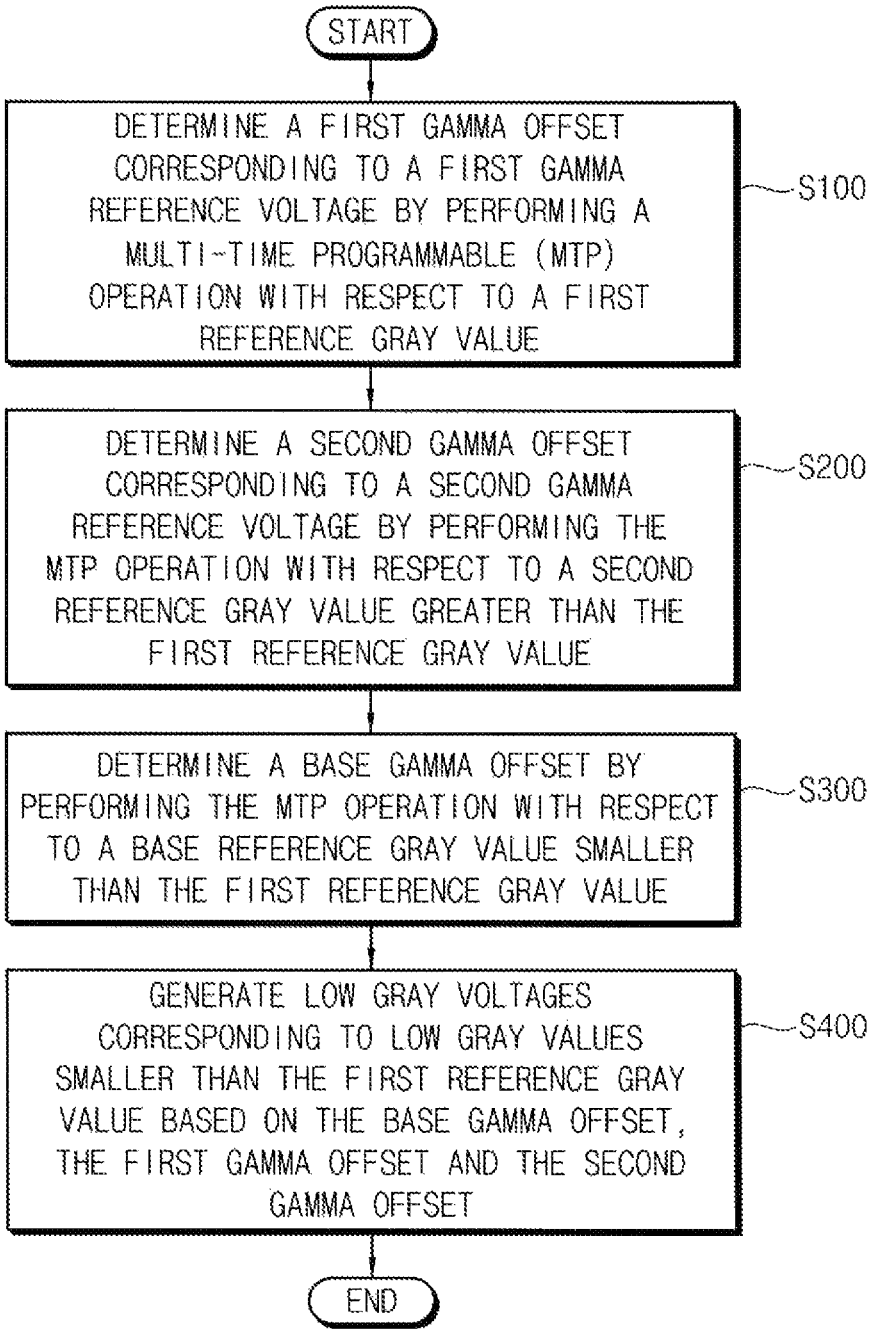
FIG. 1 is a flow chart illustrating a method of operating an electroluminescent display device according to exemplary embodiments.

The exemplary embodiments are described more fully hereinafter with reference to the accompanying drawings. Like or similar reference numerals refer to like or similar elements throughout.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a flow chart illustrating a method of operating an electroluminescent display device according to exemplary embodiments.

Referring to FIG. 1, a first gamma offset OFS1 (refer to FIGS. 4 and 6) corresponding to a first gamma reference voltage GRV1 (refer to FIG. 4) is determined by performing a multi-time programmable ("MTP") operation with respect to a first reference gray value RG1 (refer to FIG. 7A) (S100). A second gamma offset OFS2 (refer to FIGS. 4 and 6) corresponding to a second gamma reference voltage GRV2 (refer to FIG. 4) is determined by performing the MTP operation with respect to a second reference gray value RG2 (refer to FIG. 7A) greater than the first reference gray value RG1 (S200). A base gamma offset OFSb (refer to FIG. 6) is determined by performing the MTP operation with respect to a base reference gray value RGb (refer to FIG. 7A) smaller than the first reference gray value RG1 (S300).

Hereinafter, the first reference gray value RG1 and the second reference gray value RG2 associated with low gray voltages are mainly described, and the other reference gray values such as the third reference gray value, the fourth reference gray value, etc. may be described only when they are necessary.

Figure 6:
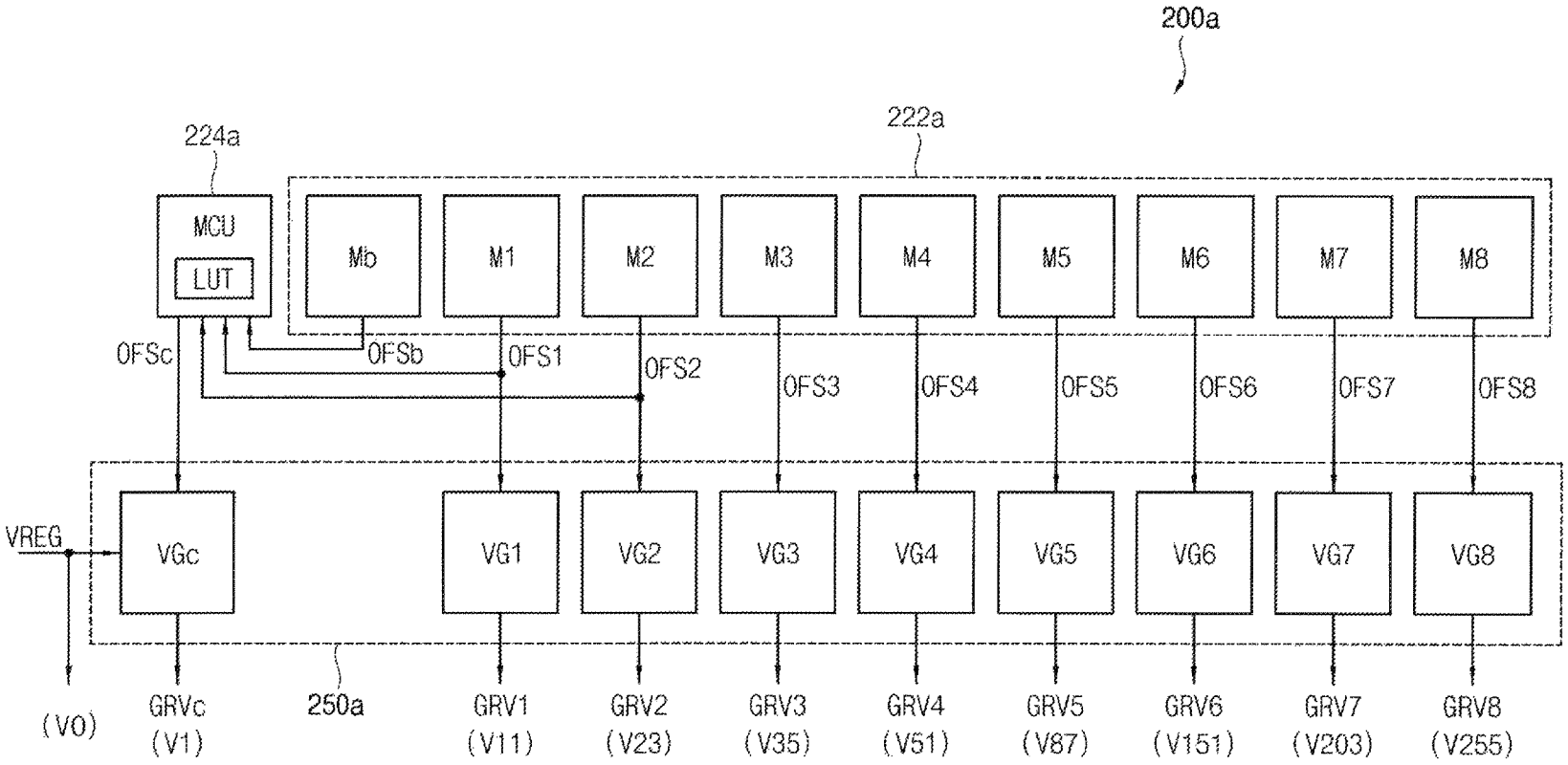
FIG. 6 is a diagram illustrating exemplary embodiments of a gamma circuit.
Figure 7A:
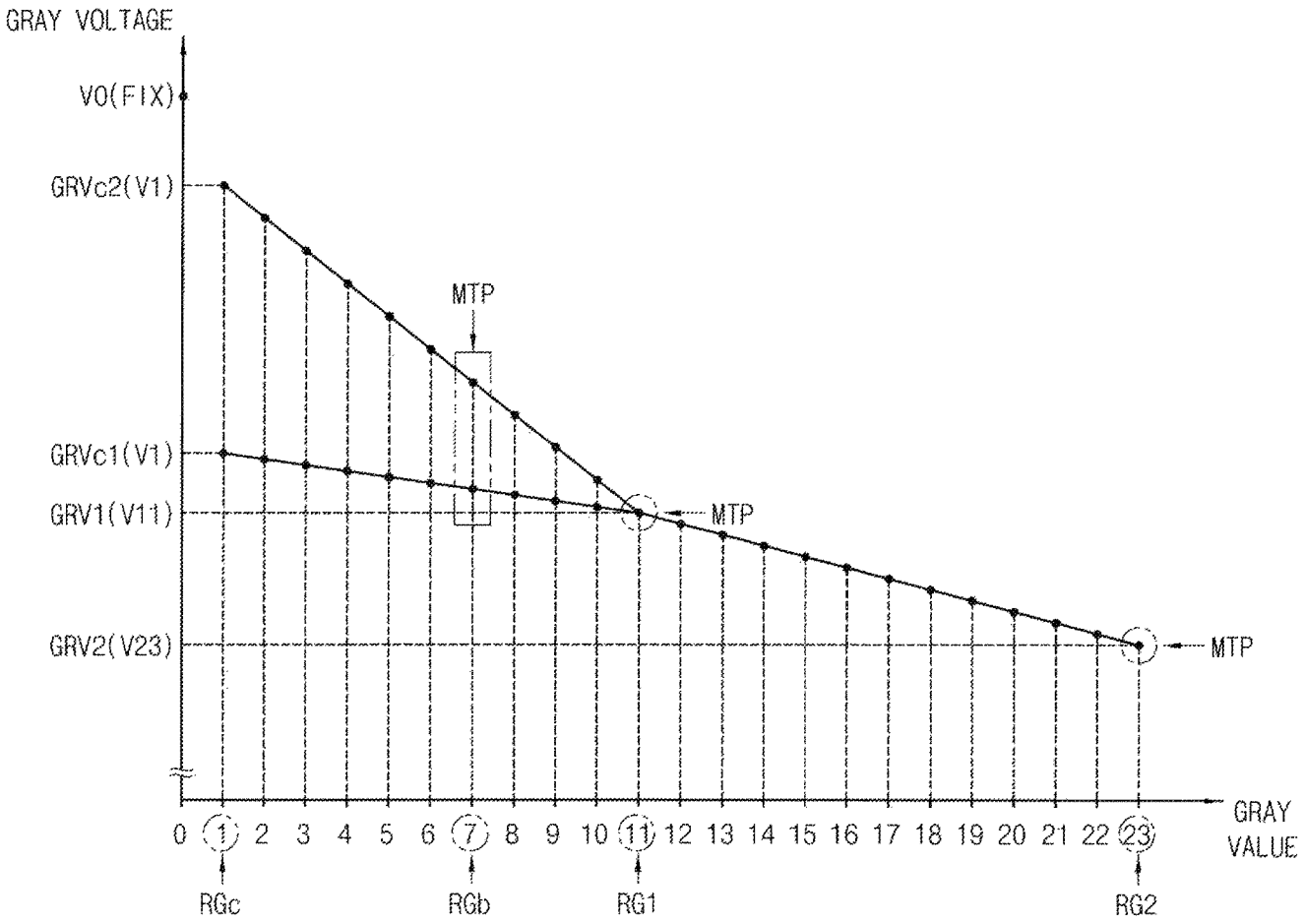

In an exemplary embodiment, as illustrated in FIGS. 6 and 7A, the first reference gray value RG1 may be 11, the second reference gray value RG2 may be 23 and the base reference gray value RGb may be 7, for example. The first reference gray value RG1 and the second reference gray value RG2 may be set to proper values for implementing a gamma curve of the electroluminescent display device. The base reference gray value RGb may be set to a gray value corresponding to a minimum brightness that may be sensed by a detecting device used in the manufacturing process of the electroluminescent display device.

Low gray voltages corresponding to low gray values smaller than the first reference gray value RG1 may be generated based on the base gamma offset OFSb, the first gamma offset OFS1 and the second gamma offset OFS2 (S400). In exemplary embodiments, as will be described below, a slope factor SF representing a trend of the low gray voltages may be determined based on the base gamma offset OFSb, the first gamma offset OFS1 and the second gamma offset OFS2, and the low gray voltages may be generated based on the slope factor SF (refer to equation 2 below).

As will be described with reference to FIGS. 10A and 10B, according to the conventional method, a gamma offset corresponding to a minimum reference gray value (e.g. a gray value of 3) near a gray value of zero may be estimated or presumed to generate a minimum gamma reference voltage, and the low gray voltages may be generated based on the estimated minimum gamma reference voltage. It is not easy to estimate the minimum gamma reference voltage exactly and the color distortion occurs with respect to the low gray values to degrade the image quality. The electroluminescent display device and the method of operating the electroluminescent display device according to exemplary embodiments may reduce color distortion of low gray values and enhance image quality of the electroluminescent display device by determining the slope factor representing trend of the low gray voltages based on the base gamma offset that is obtained through the MTP operation and by generating the low gray voltages based on the slope factor.

Figure 2:
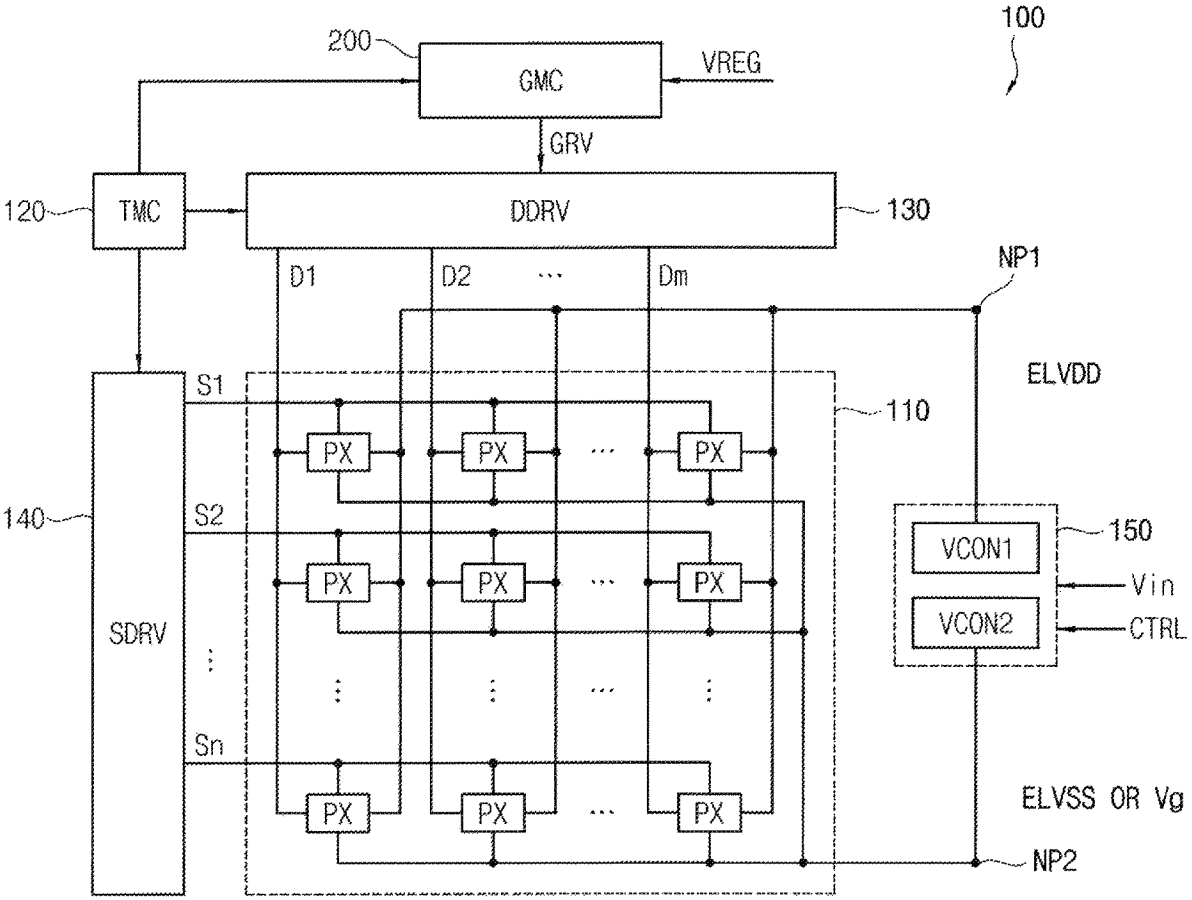
FIG. 2 is a block diagram illustrating an electroluminescent display device according to exemplary embodiments.

FIG. 2 is a block diagram illustrating an electroluminescent display device according to exemplary embodiments.

Referring to FIG. 2, an electroluminescent display device 100 may include a display panel 110, a timing controller TMC 120, a data driver DDRV 130, a scan driver SDRV 140, a power supply circuit 150 and a gamma circuit GMC 200. Even though not illustrated in FIG. 2, the electroluminescent display 100 may further include a buffer for storing image data to be displayed, etc.

The display panel 110 includes a plurality of pixels PX or pixel circuits disposed in rows and columns. In an exemplary embodiment, the pixels PX may be arranged in a matrix form of n rows and m columns as illustrated in FIG. 2, for example. The display panel 110 is connected to the data driver 130 through data lines D1 to Dm, and to the scan driver 140 through scan lines S1 to Sn. The display panel 110 is connected between a first power node NP1 and a second power node NP2 to be powered by the power supply circuit 150.

The power supply circuit 150 may operate based on control signals CTRL, and at least a portion of the control signals CTRL may be provided from the timing controller 120. The power supply circuit 150 may include a first voltage converter VCON1 and a second voltage converter VCON2. In an exemplary embodiment, an input voltage Vin provided to the power supply circuit 150 may be a direct current ("DC") voltage such as a battery voltage, and the first and second voltage converters VCON1 and VCON2 may be DC-DC converters. The first voltage converter VCON1 generates a first power supply voltage ELVDD having a positive voltage level based on the input voltage Vin to drive the first power node NP1 with the first power supply voltage ELVDD. The second voltage converter VCON2 generates a second power supply voltage ELVSS having a negative voltage level based on the input voltage Vin or generates a ground voltage Vg to drive the second power node NP2 with the second power supply voltage ELVSS or the ground voltage Vg.

The gamma circuit 200 may generate a plurality of gamma reference voltages GRV based on a regulator voltage VREG. In an exemplary embodiment, the regulator voltage VREG may be the first power supply voltage ELVDD itself or another voltage that is generated based on the first power supply voltage ELVDD, for example. The gamma circuit 200 may store a plurality of gamma offsets OFS corresponding to a plurality of gamma reference voltages GRV where the gamma offsets OFS are determined by performing a multi-time programmable ("MTP") operation with respect to a plurality of reference gray values. The gamma circuit 200 may generate the gamma reference voltages GRV based on the stored gamma offsets OFS.

In exemplary embodiments, the gamma circuit 200 may generate a minimum gamma reference voltage GRVc (refer to FIG. 6) based on a first gamma offset OFS1 (refer to FIGS. 4 and 6) corresponding to a first reference gray value RG1 (refer to FIG. 7A), a second gamma offset OFS2 (refer to FIGS. 4 and 6) corresponding to a second reference gray value RG2 (refer to FIG. 7A) greater than the first reference gray value RG1 and a base gamma offset OFSb corresponding to a base reference gray value RGb smaller than the first reference gray value RG1. As will be described with reference to FIGS. 6 through 9, the minimum gamma reference voltage GRVc may correspond to a gray value of 0 or a gray value of 1.

The data driver 130 may provide data signals to the display panel 110 through the data lines D1 to Dm. The data driver 130 may generate a plurality of gray voltages based on the gamma reference voltages GRV, and may drive the data lines D1 to Dm based on image data and the gray voltages.

As such, the gamma circuit 200 and the data driver 130 may generate the minimum gamma reference voltage GRVc based on the base gamma offset OFSb, the first gamma offset OFS1 and the second gamma offset OFS2, thereby reducing the color distortion of the low gray values and enhancing the image quality of the electroluminescent display device 100.

The scan driver 140 may provide row control signals to the display panel 110 through the scan lines S1 to Sn. The pixels PX may be located where the data lines D1 to Dm and the scan lines S1 to Sn cross. The timing controller 120 may control overall operations of the electroluminescent display 100. The timing controller 120 can provide control signals to control the display unit 110, the data driver 130, the scan driver 140, the power supply circuit 150 and the gamma circuit 200.

In some embodiments, the timing controller 120, the data driver 130, the scan driver 140, the power supply circuit 150 and the gamma circuit 200 may be implemented as a single integrated circuit ("IC"). In other embodiments, the timing controller 120, the data driver 130, the scan driver 140, the power supply circuit 150 and the gamma circuit 200 may be implemented as two or more ICs.

Figure 3:
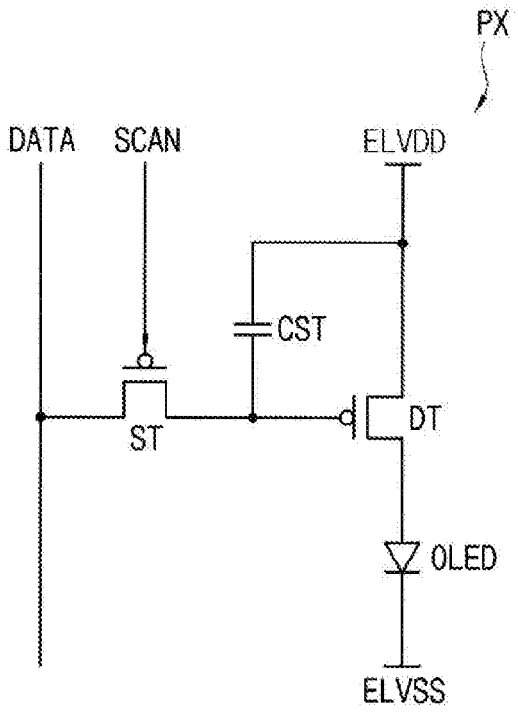
FIG. 3 is a circuit diagram illustrating an example of a pixel included in the electroluminescent display device of FIG. 2.

FIG. 3 is a circuit diagram illustrating an example of a pixel included in the electroluminescent display device of FIG. 2.

Referring to FIG. 3, each pixel PX may include a switching transistor ST, a storage capacitor CST, a driving transistor DT, and an organic light-emitting diode ("OLED"). Each of the red sub pixel R, the green sub pixel G and the green sub pixel B may have the configuration as illustrated in FIG. 3.

The switching transistor ST includes a first source/drain terminal connected to a data line, a second source/drain terminal connected to the storage capacitor CST, and a gate terminal connected to the scan line. The switching transistor ST transfers a data signal DATA received from the data driver 130 to the storage capacitor CST in response to a scan signal SCAN received from the scan driver (also referred to as "gate driver") 140.

The storage capacitor CST has a first electrode connected to a high power supply voltage ELVDD and a second electrode connected to a gate terminal of the driving transistor DT. The storage capacitor CST stores the data signal DATA transferred through the switching transistor ST.

The driving transistor DT has a first source/drain terminal connected to the high power supply voltage ELVDD, a second source/drain terminal connected to the OLED, and the gate terminal connected to the storage capacitor CST. The driving transistor DT is turned on or off according to the data signal DATA stored in the storage capacitor CST.

The OLED has an anode electrode connected to the driving transistor DT and a cathode electrode connected to a low power supply voltage ELVSS. The OLED emits light based on a current flowing from the high power supply voltage ELVDD to the low power supply voltage ELVSS while the driving transistor DT is turned on.

Figure 4:
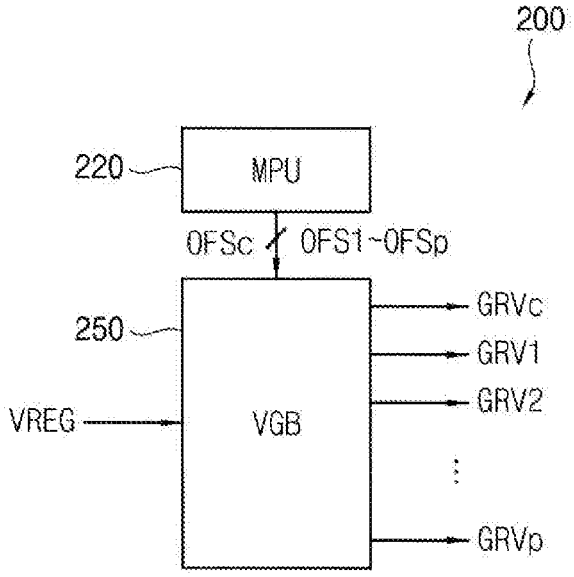
FIG. 4 is a block diagram illustrating an exemplary embodiment of a gamma circuit included in the electroluminescent display device of FIG. 2.

FIG. 4 is a block diagram illustrating an exemplary embodiment of a gamma circuit included in the electroluminescent display device of FIG. 2.

Referring to FIG. 4, a gamma circuit 200 may include an MTP processing unit MPU 220 and a voltage generation block VGB 250.

The MTP processing unit 220 may store a base gamma offset OFSb and first through p-th gamma offsets OFS1 to OFSp that are determined by performing the MTP operation, and may provide a minimum gamma offset OFSc and the first through p-th gamma offsets OFS1 to OFSp based on the stored gamma offsets OFSb and OFS1 to OFSp, where p is a positive integer. The voltage generation block 250 may generate a minimum gamma reference voltage GRVc and first through p-th gamma reference voltages GRV1 to GRVp based on the minimum gamma offset OFSc and the first through p-th gamma offsets OFS1 to OFSp. Exemplary embodiments of the gamma circuit 200 will be described below with reference to FIGS. 6 through 9.

Figure 5:
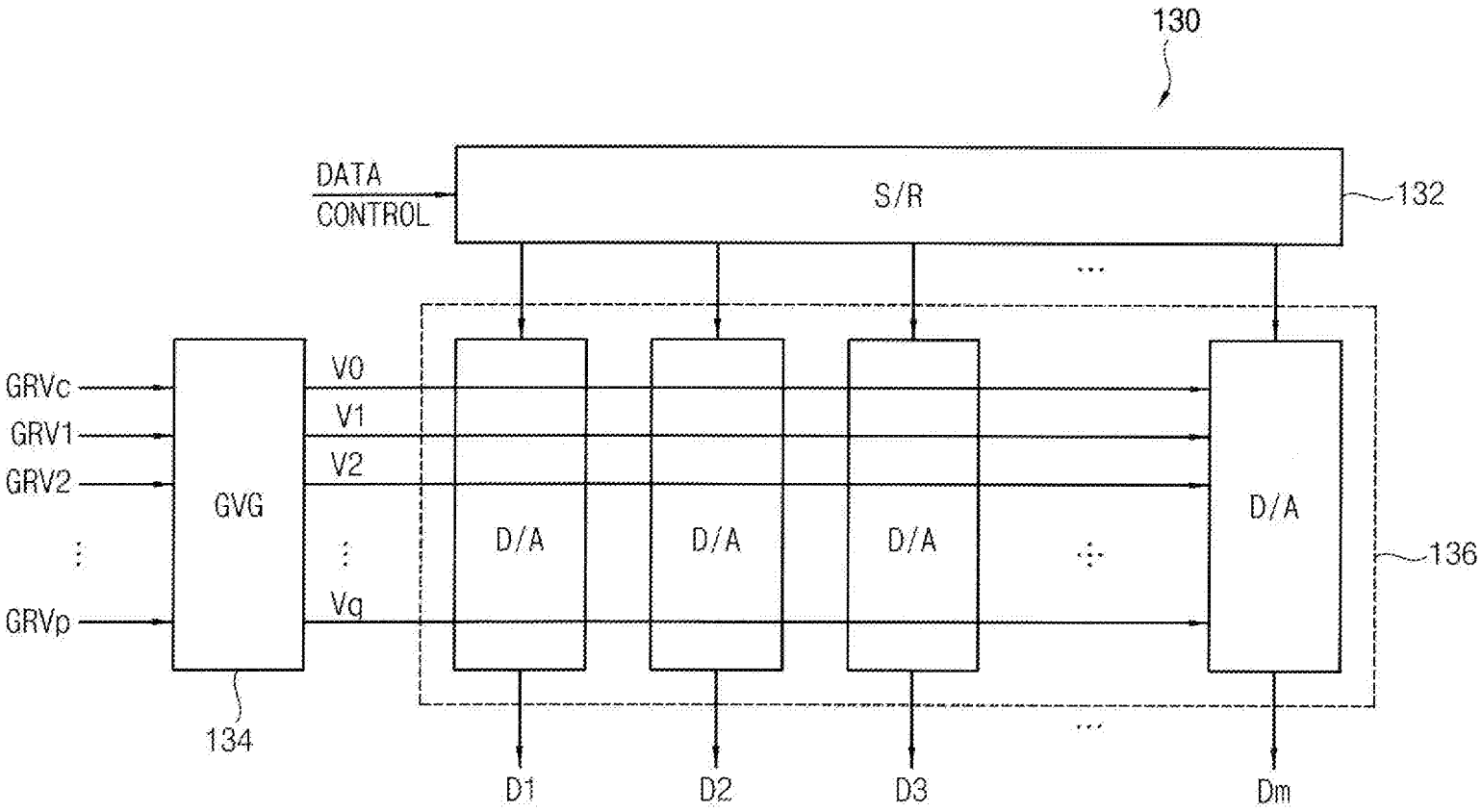
FIG. 5 is a block diagram illustrating an exemplary embodiment of a data driver included in the electroluminescent display device of FIG. 2.

FIG. 5 is a block diagram illustrating an exemplary embodiment of a data driver included in the electroluminescent display device of FIG. 2.

Referring to FIG. 5, a data driver 130 may include a shift register S/R 132, a gray voltage generator GVG 134 and a digital-to-analog converter D/A 136.

The gray voltage generator 134 may generate first through (q+1)-th gray voltages V0 to Vq based on the gamma reference voltages GRVc and GRV1 to GRVp from the gamma circuit 200, where q is a positive integer. In an exemplary embodiment, the gray voltage generator 134 may include one or more resistor strings, each linearly dividing two gamma reference voltages, to generate the gray voltages V0 to Vq, for example. In an exemplary embodiment, when the image data is comprised of eight bits, the number (q+1) of the gray values 0 to q and the gray voltages V0 to Vq may be 256, for example.

The digital-to-analog converter 136 may include a plurality of conversion units D/A receiving the gray voltages V0 to Vq. Each conversion unit D/A may select, among the gray voltages V0 to Vq, the one gray voltage corresponding to the digital data bit received from the shift register 132 to driver the corresponding data line of the data lines D1 to Dm.

The shift register 132 may receive the image data and control signal CONTROL from the timing controller 120 in FIG. 2 and may output respective data bits of the image data to the conversion units D/A corresponding to the data lines D1 to Dm, respectively.

FIG. 6 is a diagram illustrating a gamma circuit according to exemplary embodiments, and FIGS. 7A and 7B are diagrams for describing an operation of the gamma circuit of FIG. 6.

Referring to FIG. 6, a gamma circuit 200*a* may include an MTP processing unit and a voltage generation block 250*a*. The MTP processing unit may include a storage unit 222*a* and a calculation unit MCU 224*a*.

FIG. 6 illustrates a non-limiting example of eight reference gray values 11, 23, 35, 51, 87, 151, 203 and 255, eight gamma offsets OFS1 to OFS8 and eight gamma reference voltages GRV1 to GRV8, but the number of them may be changed variously.

The storage unit 222*a* may store and provide a base gamma offset OFSb, and a plurality of gamma offsets OFS1 to OFS8. The storage unit 222*a* may include a plurality of memory units Mb and M1 to M8 to store the respective gamma offsets. In an exemplary embodiment, as illustrated in FIGS. 6, 7A and 7B, the base reference gray value RGb may be 7, the first reference gray value RG1 may be 11 and the second reference gray value RG2 may be 23. The reference gray values RGb, RG1 and RG2 may be changed depending on the gamma curve of the electroluminescent display device, the sensitivity of the detecting device for the MTP operation, etc.

The calculation unit 224*a* may determine a slope factor SF based on the base gamma offset OFSb corresponding to the base reference gray value RGb, the first gamma offset OFS1 corresponding to the first reference gray value RG1 and the second gamma offset OFS2 corresponding to the second reference gray value RG2, where the slope factor SF represents a trend of the low gray voltages corresponding to the low gray values lower than the first reference gray value RG1. The calculation unit 224*a* may calculate a minimum gamma reference voltage GRVc corresponding to a minimum reference gray value RGc smaller than the base reference gray value RGb based on the slope factor SF, a first gamma reference voltage GRV1 corresponding to the first gamma offset OFS1 and a second gamma reference voltage GRV2 corresponding to the second gamma offset OF S2. The calculation unit 224*a* may provide a minimum gamma offset OFSc corresponding to the calculated minimum gamma reference voltage GRVc.

The calculation unit 224*a* may include a lookup table LUT as illustrated in FIG. 11. The gamma offsets and the corresponding gamma reference voltages may be mapped to each other and stored in the lookup table LUT. The calculation unit 224*a* may refer to the lookup table LUT to extract the gamma reference voltage corresponding to the gamma offset or to extract the gamma offset corresponding to the gamma reference voltage.

The voltage generation block 250*a* may generate the minimum gamma reference voltage GRVc and the first through eighth gamma reference voltage GRV1 to GRV8 based on the minimum gamma offset OFSc and the first through eighth gamma offsets OFS1 to OFS8. The voltage generation block 250*a* may include a plurality of voltage generation units VGc and VG1 to VG8 for generating the minimum gamma reference voltage GRVc and the first through eighth gamma reference voltage GRV1 to GRV8, respectively.

In exemplary embodiments, as illustrated in FIGS. 6, 7A and 7B, the minimum reference gray value RGc may correspond to a gray value of 1. In this case, a gray voltage V0 corresponding to a gray value of 0 may have a fixed voltage regardless of the MTP operation. In an exemplary embodiment, the regulator voltage VREG, which is input to the gamma circuit 200*a*, may be provided to the gray voltage generator 134 in FIG. 5 and the regulator voltage VREG itself may be used as the gray voltage V0 corresponding to the gray value of 0.

Referring to FIGS. 7A and 7B, the low gray voltages V1 to V10 corresponding to the low gray values 1 to 10 lower than the first reference gray value RG1=11 may be determined finely by performing the MTP operation with respect to the base reference gray value RGb.

As illustrated in FIG. 7*b*, the low gray voltages V1 to V10 may be determined as represented by Equation 1.

$$V(i)=V(GR1)+(V(GR1)-V(GR2))*(GR2-GR1-1-i)*K/(GR2-GR1) \quad \text{(Equation 1)}$$

In Equation 1, GR1 is the first reference gray value (e.g., 11), GR2 is the second reference gray value (e.g., 23), K is a proportional constant, i is the low gray values (e.g., 1 to 10), and V(i) is the gray value corresponding to the gray value of i.

Referring to Equation 1, the above-mentioned slope factor SF may be determined as represented by Equation 2.

$$SF=-(V(GR1)-V(GR2))*(V11-V23)*K/12 \quad \text{(Equation 2)}$$

The slope factor SF may represent the trend of the low gray voltages V1 to V10 corresponding to the low gray values 1 to 10. The slope factor SF may correspond to a changing amount of the low gray voltages when the low gray value increases by one. The slope factor SF may have a negative value as illustrated in FIG. 7A.

The proportional constant K may be determined by performing the MTP operation with respect to the base reference gray value RGb. In an exemplary embodiment, the base gamma offset OFSb corresponding to the base gamma reference voltage GRVb=V7 may be determined by performing the MTP operation with respect to the gray value of 7, the first gamma offset OFS1 corresponding to the first gamma reference voltage GRV1=V11 may be determined by performing the MTP operation with respect to the gray value of 11, and the second gamma offset OFS2 corresponding to the second gamma reference voltage GRV2=V23 may be determined by performing the MTP operation with respect to the gray value of 23, for example. The base gamma offset OFSb, the first gamma offset OFS1 and the second gamma offset OFS2 may be stored in the corresponding memory units Mb, M1 and M2 of the storage unit 222*a*, respectively. The calculation unit 224*a* may refer to the lookup table LUT to extract the base gamma reference voltage GRVb, the first gamma reference voltage GRV1 and the second gamma reference voltage GRV2 corresponding to the base gamma offset OFSb, the first gamma offset OFS1 and the second gamma offset OFS2 and to calculate the proportional constant K. Once the proportional constant K is determined, the voltage levels of the low gray voltages V1 to V10 may be determined from Equation 1.

The red (R) pixel, the green pixel (G) and the blue (B) pixel included in the display panel 110 in FIG. 2 have different gamma characteristics and thus independent gamma reference voltages and the gray voltages based thereon are required for the respective colors. The MTP operation may be performed per color and the gamma offset and the gamma reference voltages may be determined per color, that is, for the red (R), green (G) and blue (B) respectively as illustrated in FIG. 11. Accordingly the proportional constant K may be determined per color and the above-mentioned slope factor SF may include a red slope factor corresponding to the red pixels, a green slope factor corresponding to the green pixels and a blue slope factor corresponding to the blue pixels.

Figure 8:
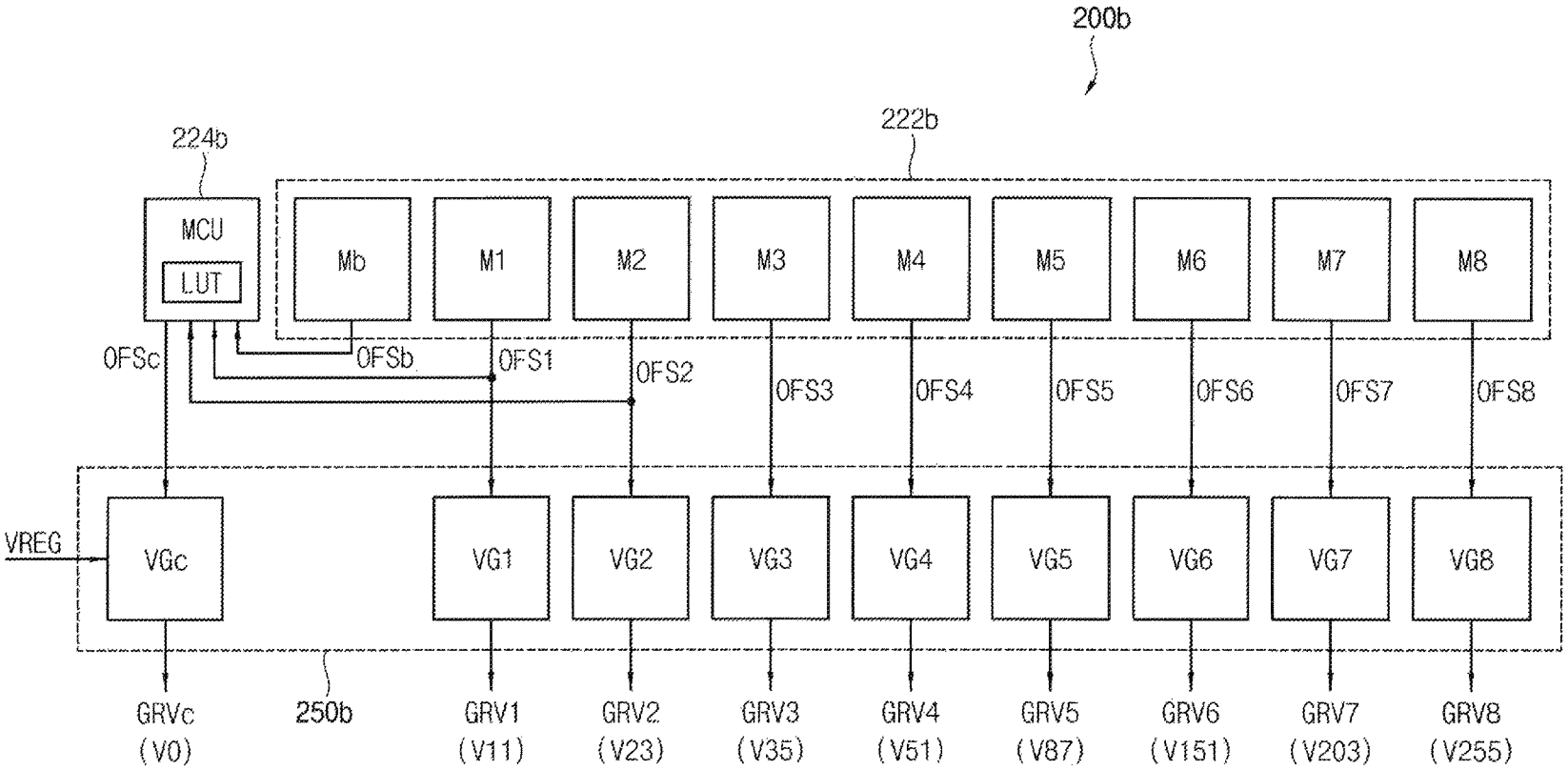
FIG. 8 is a diagram illustrating exemplary embodiments of a gamma circuit.
Figure 9A:
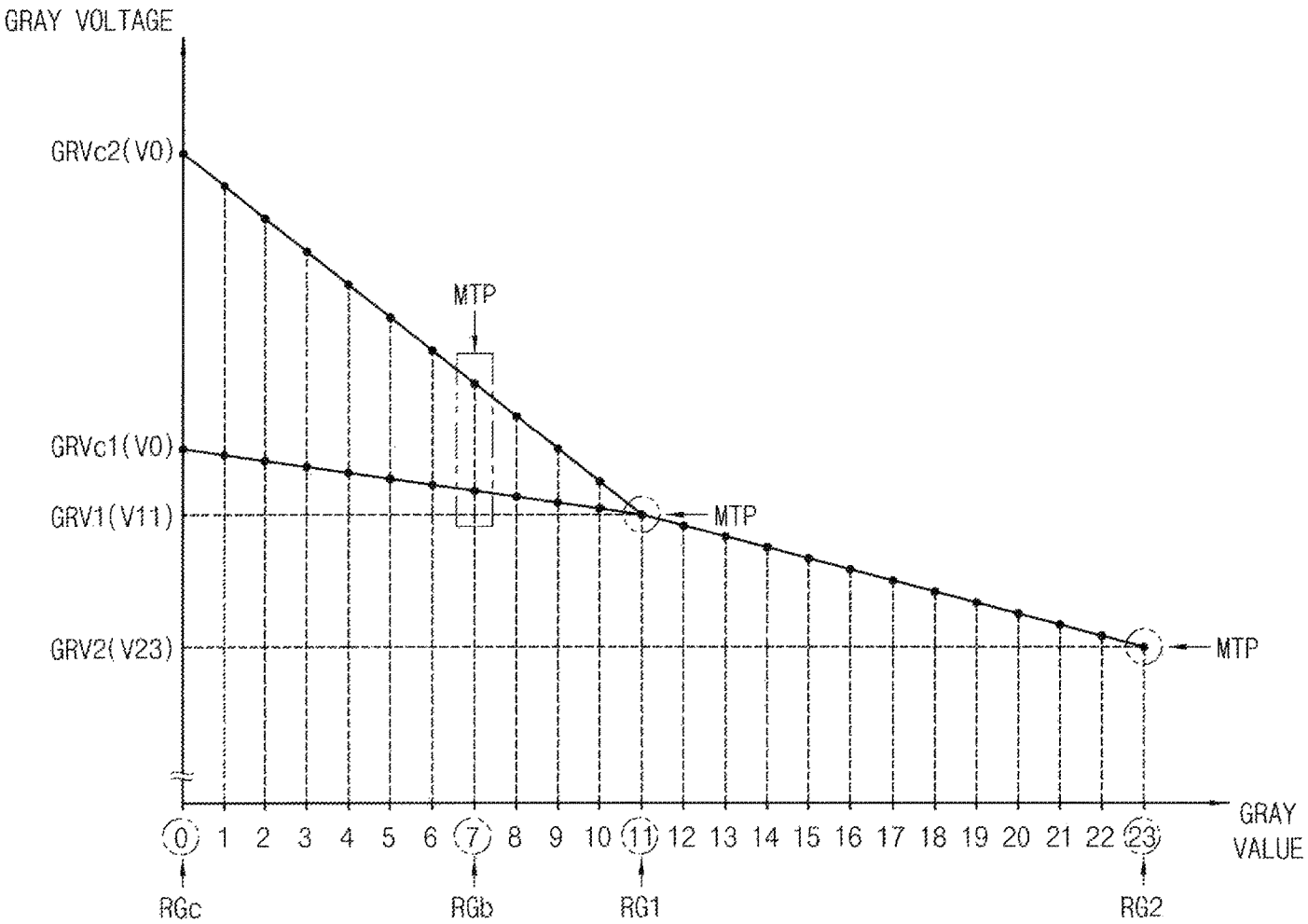

FIG. 8 is a diagram illustrating a gamma circuit according to exemplary embodiments, and FIGS. 9A and 9B are diagrams for describing an operation of the gamma circuit of FIG. 8.

FIG. 8 illustrates a non-limiting example of eight reference gray values 11, 23, 35, 51, 87, 151, 203 and 255, eight gamma offsets OFS1 to OFS8 and eight gamma reference voltages GRV1 to GRV8, but the number of them may be changed variously.

The storage unit 222*b* may store and provide a base gamma offset OFSb, a plurality of gamma offsets OFS1 to OFS8. The storage unit 222*b* may include a plurality of memory units Mb and M1 to M8 to store the respective gamma offsets. In an exemplary embodiment, as illustrated in FIGS. 8, 9A and 9B, the base reference gray value RGb may be 7, the first reference gray value RG1 may be 11 and the second reference gray value RG2 may be 23, for example. The reference gray values RGb, RG1 and RG2 may be changed depending on the gamma curve of the electroluminescent display device, the sensitivity of the detecting device for the MTP operation, etc.

The calculation unit 224*b* may determine a slope factor SF based on the base gamma offset OFSb corresponding to the base reference gray value RGb, the first gamma offset OFS1 corresponding to the first reference gray value RG1 and the second gamma offset OFS2 corresponding to the second reference gray value RG2, where the slope factor SF represents a trend of the low gray voltages corresponding to the low gray values lower than the first reference gray value RG1. The calculation unit 224*b* may calculate a minimum gamma reference voltage GRVc corresponding to a minimum reference gray value RGc smaller than the base reference gray value RGb based on the slope factor SF, a first gamma reference voltage GRV1 corresponding to the first gamma offset OFS1 and a second gamma reference voltage GRV2 corresponding to the second gamma offset OF S2. The calculation unit 224*b* may provide a minimum gamma offset OFSc corresponding to the calculated minimum gamma reference voltage GRVc.

The calculation unit 224*b* may include a lookup table LUT as illustrated in FIG. 11. The gamma offsets and the corresponding gamma reference voltages may be mapped to each other and stored in the lookup table LUT. The calculation unit 224*b* may refer to the lookup table LUT to extract the gamma reference voltage corresponding to the gamma offset or to extract the gamma offset corresponding to the gamma reference voltage.

The voltage generation block 250*b* may generate the minimum gamma reference voltage GRVc and the first through eighth gamma reference voltage GRV1 to GRV8 based on the minimum gamma offset OFSc and the first through eighth gamma offsets OFS1 to OFS8. The voltage generation block 250*b* may include a plurality of voltage generation units VGc and VG1 to VG8 for generating the minimum gamma reference voltage GRVc and the first through eighth gamma reference voltage GRV1 to GRV8, respectively.

In exemplary embodiments, as illustrated in FIGS. 8, 9A and 9B, the minimum reference gray value RGc may correspond to a gray value of 0.

Referring to FIGS. 9A and 9B, the low gray voltages V0 to V10 corresponding to the low gray values 0 to 10 lower than the first reference gray value RG1=11 may be determined finely by performing the MTP operation with respect to the base reference gray value RGb.

As illustrated in FIG. 9*b*, the low gray voltages V0 to V10 may be determined as represented by Equation 1. Here, i is the low gray values (e.g., 0 to 10), and V(i) is the gray value corresponding to the gray value of i.

The slope factor SF may represent the trend of the low gray voltages V0 to V10 corresponding to the low gray values 0 to 10. The slope factor SF may correspond to a changing amount of the low gray voltages when the low gray value increases by one. The slope factor SF may have a negative value as illustrated in FIG. 9A.

The proportional constant K may be determined by performing the MTP operation with respect to the base reference gray value RGb. In an exemplary embodiment, the base gamma offset OFSb corresponding to the base gamma reference voltage GRVb=V7 may be determined by performing the MTP operation with respect to the gray value of 7, the first gamma offset OFS1 corresponding to the first gamma reference voltage GRV1=V11 may be determined by performing the MTP operation with respect to the gray value of 11, and the second gamma offset OFS2 corresponding to the second gamma reference voltage GRV2=V23 may be determined by performing the MTP operation with respect to the gray value of 23. The base gamma offset OFSb, the first gamma offset OFS1 and the second gamma offset OFS2 may be stored in the corresponding memory units Mb, M1 and M2 of the storage unit 222*b*, respectively. The calculation unit 224*b* may refer to the lookup table LUT to extract the base gamma reference voltage GRVb, the first gamma reference voltage GRV1 and the second gamma reference voltage GRV2 corresponding to the base gamma offset OFSb, the first gamma offset OFS1 and the second gamma offset OFS2 and to calculate the proportional constant K. Once the proportional constant K is determined, the voltage levels of the low gray voltages V0 to V10 may be determined from Equation 1.

Figure 10A:
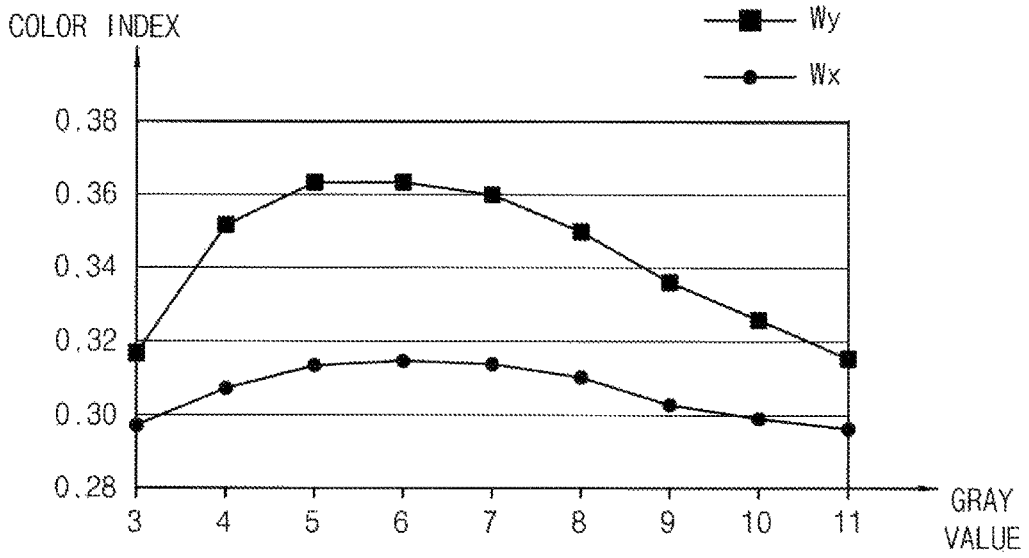
FIGS. 10A and 10B are diagrams for describing an effect of exemplary embodiments of reducing color distortion of low gay values according t.
Figure 10B:
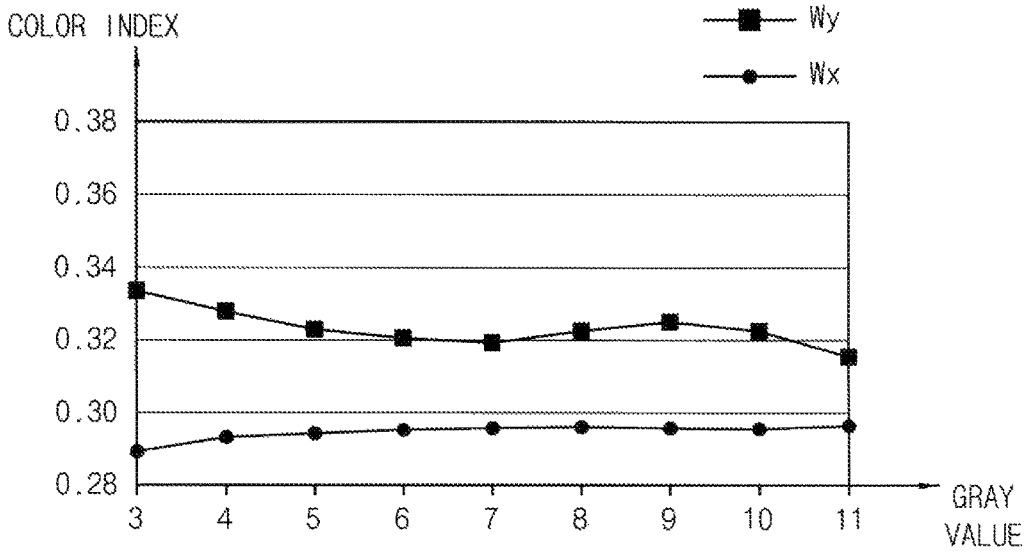

FIGS. 10A and 10B are diagrams for describing an effect of reducing color distortion of low gay values according to exemplary embodiments.

FIG. 10A illustrates color index (Wx, Wy) of the gray voltages that are determined by performing an interpolation of the third and eleventh gray voltages V3 and V11 corresponding to the gray values of 3 and 11. The brightness corresponding to the gray value of 3 is about 0.020 nit (cd/m$^2$) and the detecting device cannot guarantee such low brightness. Therefore, when the third gray voltage V3 is estimated as the gamma reference voltage and the low gray voltages V4 to V10 are generated based on the third gray voltage V3, there may occur the color distortion with respect to the low gray voltages V4 to V10 because the third gray voltage V3 may be inexact. In addition, because the gray voltages are designed linearly whereas the OLED has non-linear characteristics, the color distortion may occur with respect to the intermediate gray values 4 to 10 as illustrated in FIG. 10A, even though the third gray voltage V3 may be estimated exactly.

FIG. 10B illustrates color index (Wx, Wy) of the gray voltages that are determined by performing an extrapolation of the first gamma reference voltage GRV1 and the second gamma reference voltage GRV2, e.g., the eleventh and twenty third gray voltages V11 and V11 corresponding to the gray values of 11 and 23, using the slope factor SF as a weight value. As illustrated in FIG. 10B, the color index (Wx, Wy) is provided uniformly and the color distortion may be improved with respect to the intermediate gray voltage V7.

FIG. 11 is a diagram illustrating an example mapping relation between gamma offsets and gamma reference voltages.

Referring to a lookup table LUT of FIG. 11 representing the mapping relation between the gamma offsets OFS and the gamma reference voltages GRV, the gamma offsets OFS and the gamma reference voltages GRV may be determined per color by performing the MTP operation with respect to red (R), green (G) and blue (B). Accordingly the above-mentioned proportional constant K may be determined per color, and the above-mentioned slope factor SF may include a red slope factor corresponding to red pixels, a green slope factor corresponding to green pixels and a blue slope factor corresponding to blue pixels.

FIG. 11 illustrates a plurality of mapping relations between the gamma offsets OFS and the gamma reference voltages GRV corresponding to a plurality of cases CASE1 to CASEk.

In exemplary embodiments, the cases CASE1 to CASEk may correspond to a plurality of temperature intervals. The pixels have operational characteristics changing according to the operational temperature, and thus the different gray voltages need to be provided according to the operational temperature. As such, the above-mentioned proportional constant K may be determined per temperature interval, and each of the red slope factor, the green slope factor and the blue slope factor may include a plurality of values corresponding to the temperature intervals.

In other exemplary embodiments, the cases CASE1 to CASEk may correspond to a plurality of dimming brightness intervals. The dimming operation may be performed so as to reduce the brightness of the displayed image entirely. The brightness may be divided into the brightness intervals, for example, based on 80%, 60%, 40% of the maximum brightness and the entire brightness of the image may be reduced gradationally. As such, the above-mentioned proportional constant K may be determined per dimming brightness interval, and each of the red slope factor, the green slope factor and the blue slope factor may include a plurality of values corresponding to the dimming brightness intervals.

Figure 12:
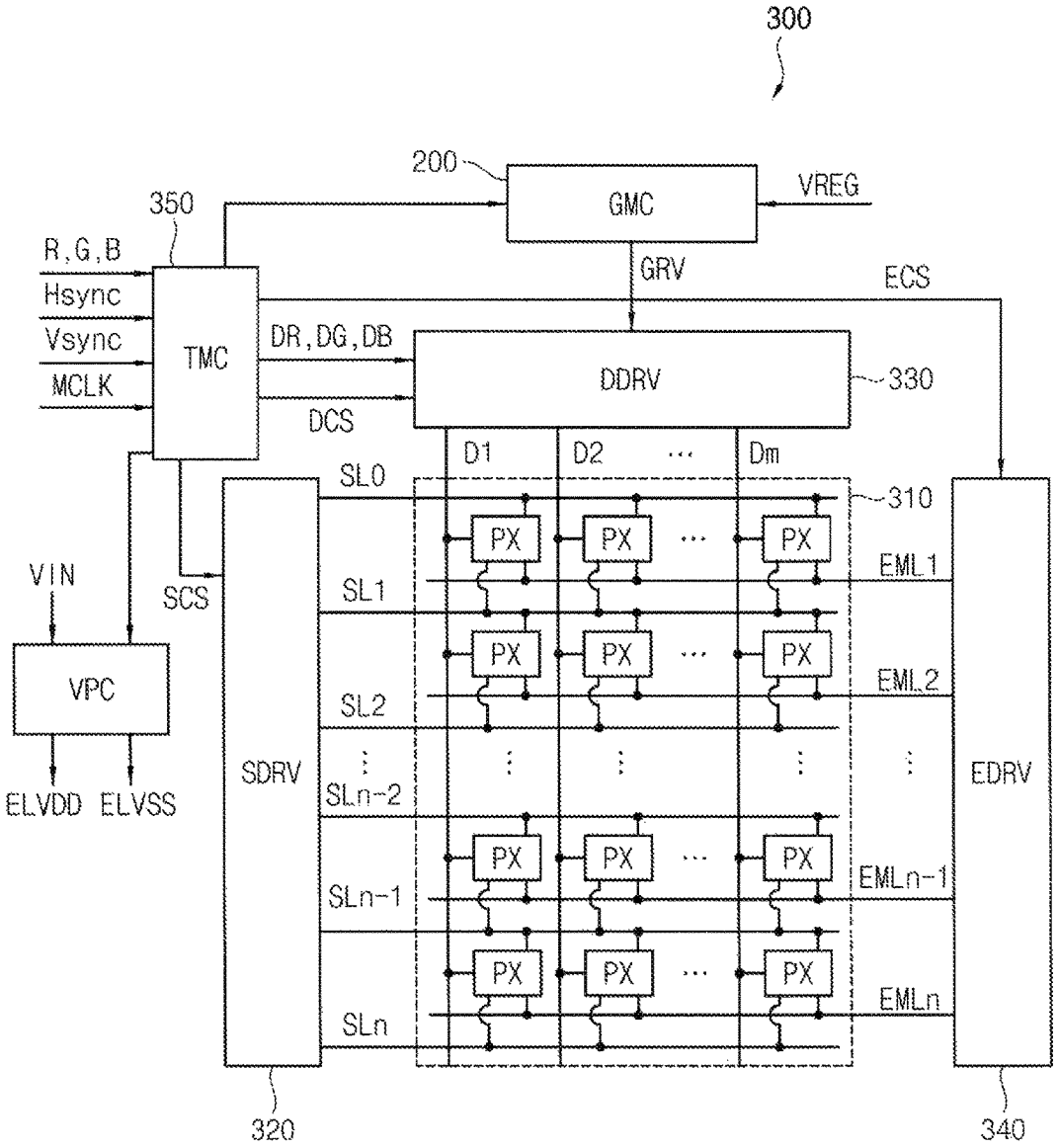
FIG. 12 is a block diagram illustrating exemplary embodiments of an electroluminescent display device.

FIG. 12 is a block diagram illustrating an electroluminescent display device according to exemplary embodiments.

A display device 300 or display module illustrated in FIG. 12 may be an electroluminescent display device including a light-emitting diode ("LED") or an organic light-emitting diode ("OLED") that emits light through recombination of electrons and holes.

The display device 300 may include a display panel 310 including a plurality of pixels PX, a scan driver SDRV 320, a data driver DDRV 330, an emission control driver EDRV 340, a timing controller TMC 350, a voltage providing circuit VPC 100 and a gamma circuit GWC 200.

Figure 13:
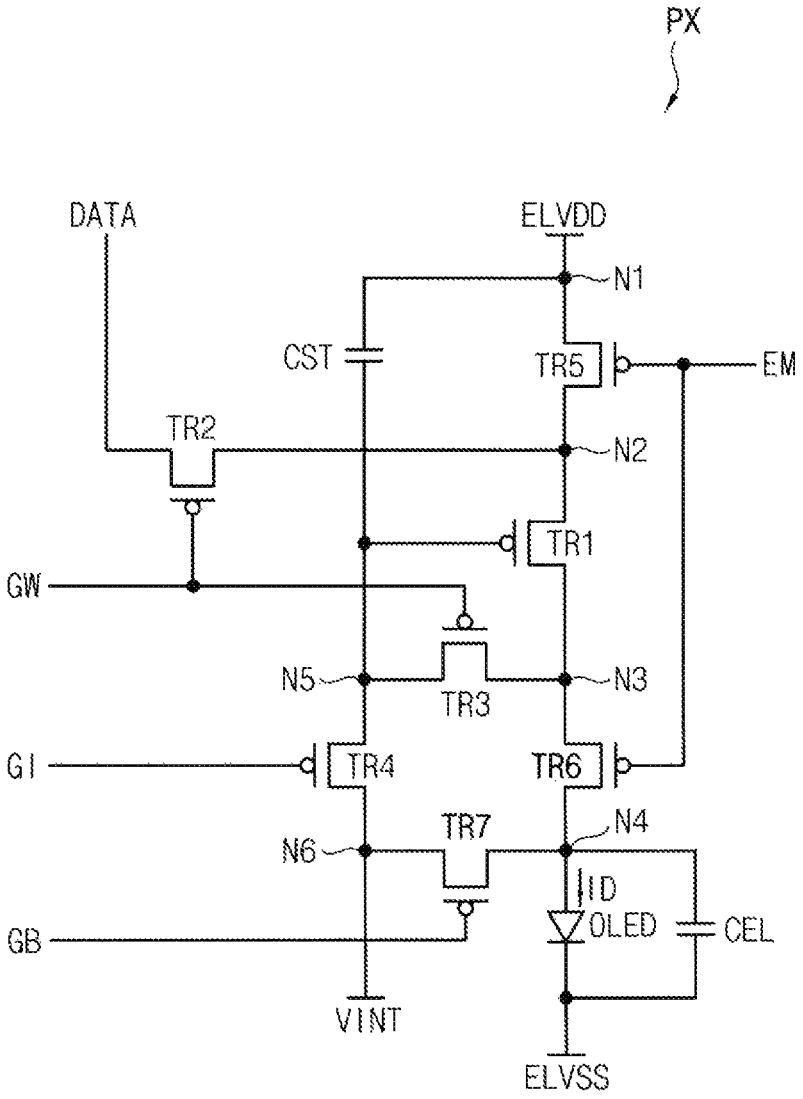
FIG. 13 is a circuit diagram illustrating an example of a pixel included in the electroluminescent display device of FIG. 12.

The scan driver 320 may provide row control signals GW, GI, and GB as illustrated in FIG. 13 to the pixels PX by units of rows through row control lines SLO to SLn. The data driver 330 may provide data signals DATA as illustrated in FIG. 13 to the pixels PX by units of columns through data lines D1 to Dm. The emission control driver 340 may provide emission control signals EM as illustrated in FIG. 13 to the pixels PX by units of rows through emission control lines EML1 to EMLn.

The timing controller 350 may receive and convert image signals R, G, B from an external device and provide converted image data DR, DG, DB to the data driver 330. Also the timing controller 350 may receive a vertical synchronization signal Vsync, a horizontal synchronization signal Hsync, and a clock signal MCLK from the external device and generate control signals for the scan driver 320, the data driver 330, and the emission control driver 340. The timing controller 350 provides scan driving control signals SCS to the scan driver 320, data driving control signals DCS to the data driver 330, and emission driving control signals ECS to the emission control driver 340, respectively. Each pixel PX emits light by a driving current flowing through the LED or the OLED based on the data signals provided through the data lines D1 to Dm.

The data driver 330 generates the data signals based on the data voltage VDH. The display panel 310 receives the power supply voltage ELVDD and the pixels PX in the display panel 310 are driven based on the power supply voltage ELVSS and the data signals from the data driver 330. The timing controller 350 generates the ready signal indicating the power supply timing.

The gamma circuit 200 may generate a plurality of gamma reference voltages GRV based on a regulator voltage VREG. In an exemplary embodiment, the regulator voltage VREG may be the first power supply voltage ELVDD itself or another voltage that is generated based on the first power supply voltage ELVDD. The gamma circuit 200 may store a plurality of gamma offsets OFS corresponding to a plurality of gamma reference voltages GRV where the gamma offsets OFS are determined by performing a multi-time programmable ("MTP") operation with respect to a plurality of reference gray values. The gamma circuit 200 may generate the gamma reference voltages GRV based on the stored gamma offsets OFS.

The gamma circuit 200 may generate a minimum gamma reference voltage GRVc based on a first gamma offset OFS1 corresponding to a first reference gray value RG1, a second gamma offset OFS2 corresponding to a second reference gray value RG2 greater than the first reference gray value RG1 and a base gamma offset OFSb corresponding to a base reference gray value RGb smaller than the first reference gray value RG1. As described with reference to FIGS. 6 through 9, the minimum gamma reference voltage GRVc may correspond to a gray value of 0 or a gray value of 1.

The data driver 330 may provide data signals to the display panel 310 through the data lines D1 to Dm. The data driver 330 may generate a plurality of gray voltages based on the gamma reference voltages GRV, and may drive the data lines D1 to Dm based on image data and the gray voltages.

As such, the gamma circuit 200 and the data driver 130 may generate the minimum gamma reference voltage GRVc based on the base gamma offset OFSb, the first gamma offset OFS1 and the second gamma offset OFS2, thereby reducing the color distortion of the low gray values and enhancing the image quality of the electroluminescent display device 100.

FIG. 13 is a circuit diagram illustrating an example of a pixel included in the electroluminescent display device of FIG. 12.

Referring to FIG. 13, a pixel PX may include an OLED, a first transistor TR1, a second transistor TR2, a third transistor TR3, a storage capacitor CST, a fourth transistor TR4, a fifth transistor TR5, a sixth transistor TR6, and a seventh transistor TR7, which are connected through first through sixth nodes N1 through N6. In an exemplary embodiment, the pixel PX may further include a diode parallel capacitor CEL. In another exemplary embodiment, the diode parallel capacitor CEL may be a capacitor provided by a parasitic capacitances.

The OLED may emit light based on a driving current ID. The anode of the OLED may be to a negative power voltage ELVSS or a ground voltage and the cathode of the OLED may be coupled to the fourth node N4.

The first transistor TR1 may include a gate electrode connected to the fifth node N5, a source electrode coupled to the second node N2, and a drain electrode coupled to the third node N3. The first transistor TR1 may generate the driving current ID. The digital driving may be performed such that the grayscale is represented by the sum of the times in each frame during which the driving current ID is provided to the OLED.

The second transistor TR2 may include a gate electrode receiving a scan signal SW, a source electrode receiving the data signal DATA, and a drain electrode coupled to the second node N2. The second transistor TR2 may transfer the data signal DATA to the source electrode of the first transistor TR1 during the activation time interval of the scan signal SW.

The third transistor TR3 may include a gate electrode receiving the scan signal SW, a source electrode coupled to the fifth node N5, and a drain electrode coupled to the third node N3. The third transistor TR3 may electrically couple the gate electrode of the first transistor TR1 and the drain electrode of the first transistor TR1 during the activation time interval of the scan signal SW. In other words, the third transistor TR3 may form a diode-connection of the first transistor TR1 during the activation time interval of the scan signal SW. Through such diode-connection, the data signal DATA compensated with the respective threshold voltage of the first transistor TR1 may be provided to the gate electrode of the first transistor TR1. Such threshold voltage compensation may prevent or reduce irregularity of the driving current ID due to deviations of the threshold voltage of the first transistor TR1.

The storage capacitor CST may be coupled between the first node N1 and the fifth node N5. The storage capacitor CST maintains the voltage level on the gate electrode of the first transistor TR1 during the deactivation time interval of the scan signal SW. The deactivation time interval of the scan signal SW may include the activation time interval of an emission control signal EM. The driving current ID generated by the first transistor TR1 may be applied to the OLED during the activation time interval of the emission control signal EM.

The fourth transistor TR4 may include a gate electrode receiving a data initialization signal GI, a source electrode connected to the fifth node N5 and a drain electrode coupled to the sixth node N6. The fourth transistor TR4 may provide an initialization voltage VINT to the gate electrode of the first transistor TR1 during the activation time interval of the data initialization signal GI. In other words, the fourth transistor TR4 may initialize the gate electrode of the first transistor TR1 with the initialization voltage VINT during the activation time interval of the data initialization signal GI.

The fifth transistor TR5 may include a gate electrode receiving the emission control signal EM, a source electrode coupled to the first node N1, and a drain electrode coupled to the second node N2. The fifth transistor TR5 may provide the power supply voltage ELVDD to the second node N2 during the activation time interval of the emission control signal EM. In contrast, the fifth transistor TR5 may disconnect the second node N2 from the power supply voltage ELVDD during the deactivation time interval of the emission control signal EM. The first transistor TR1 may generate the driving current ID while the fifth transistor TR5 provides the power supply voltage ELVDD to the second node N2 during the activation time interval of the emission control signal EM. In addition, the data signal DATA compensated with the threshold voltage of the first transistor TR1 may be provided to the gate electrode of the first transistor TR1 while the fifth transistor TR5 disconnects the second node N2 from the power supply voltage ELVDD during the deactivation time interval of the emission control signal EM.

The sixth transistor TR6 may include a gate electrode receiving the emission control signal EM, a source electrode coupled to the third node N3, and a drain electrode coupled to the fourth node N4. The sixth transistor TR6 may provide the driving current ID generated by the first transistor TR1 to the OLED during the activation time interval of the emission control signal EM.

The seventh transistor TR7 may include a gate electrode receiving a diode initialization signal GB, a source electrode coupled to the sixth node N6, and a drain electrode coupled to the fourth node N4. The seventh transistor TR7 may provide the initialization voltage VINT to the anode of the OLED during the activation time interval of the diode initialization signal GB. In other words, the seventh transistor TR7 may initialize the anode of the OLED with the initialization voltage VINT during the activation time interval of the diode initialization signal GB.

In exemplary embodiments, the diode initialization signal GB may be the same as the data initialization signal GI. The initialization of the gate electrode of the first transistor TR1 and the initialization of the anode of the OLED may not affect each other, that is, independent of each other. Thus the diode initialization signal GB and the data initialization signal GI may be combined as one signal. The initialization voltage VINT may depend on the characteristics of the diode parallel capacitor CEL and the initialization voltage VINT may be set to a sufficiently low voltage. In an exemplary embodiment, the initialization voltage VINT may be set to the negative power supply voltage ELVSS or the ground voltage.

Figure 14:
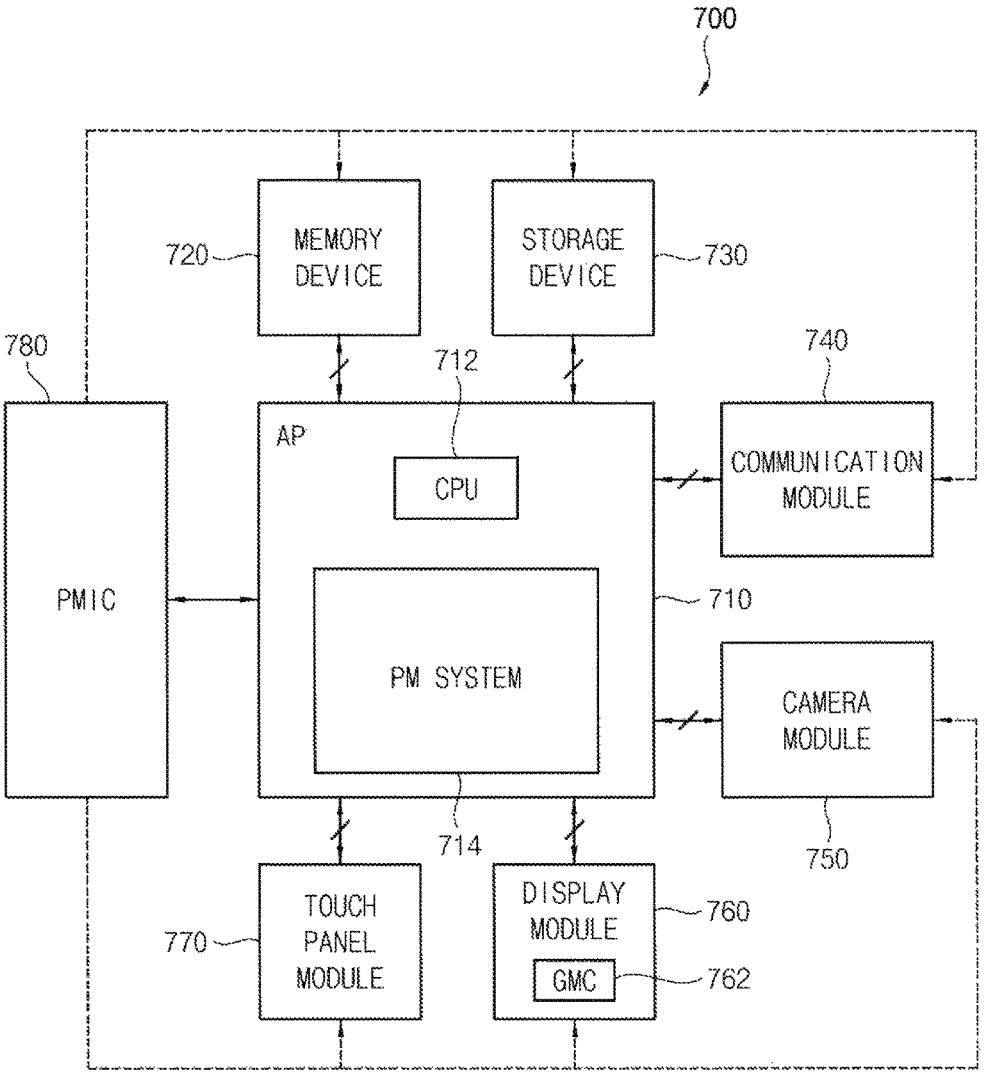
FIG. 14 is a block diagram illustrating exemplary embodiments of a mobile device.

FIG. 14 is a block diagram illustrating a mobile device according to exemplary embodiments.

Referring to FIG. 14, a mobile device 700 includes a system on chip ("SoC") 710 and a plurality of functional modules 740, 750, 760 and 770. The mobile device 700 may further include a memory device 720, a storage device 730 and a power management device 780.

The SoC 710 controls overall operations of the mobile device 700. In an exemplary embodiment, the SoC 710 controls the memory device 720, the storage device 730 and the plurality of functional modules 740, 750, 760 and 770, for example. The SoC 710 may be an application processor ("AP") that is included in the mobile device 700.

The SoC 710 may include a CPU 712 and a power management system PM SYSTEM 714. The memory device 720 and the storage device 730 may store data for operations of the mobile device 700. In an exemplary embodiment, the memory device 720 may include a volatile memory device, such as a dynamic random access memory ("DRAM"), a static random access memory ("SRAM"), a mobile DRAM, etc. In an exemplary embodiment, the storage device 730 may include a nonvolatile memory device, such as an erasable programmable read-only memory ("EPROM"), an electrically EPROM ("EEPROM"), a flash memory, a phase change random access memory ("PRAM"), a resistance random access memory ("RRAM"), a nano floating gate memory ("NFGM"), a polymer random access memory ("PoRAM"), a magnetic random access memory ("MRAM"), a ferroelectric random access memory ("FRAM"), etc. In exemplary embodiments, the storage device 730 may further include a solid state drive ("SSD"), a hard disk drive ("HDD"), a CD-ROM, etc.

The functional modules 740, 750, 760 and 770 perform various functions of the mobile device 700. In an exemplary embodiment, the mobile device 700 may include a communication module 740 that performs a communication function (e.g., a code division multiple access ("CDMA") module, a long term evolution ("LTE") module, a radio frequency (RF) module, an ultra-wideband ("UWB") module, a wireless local area network (WLAN) module, a worldwide interoperability for a microwave access ("WIMAX") module, etc.), a camera module 750 that performs a camera function, a display module 760 that performs a display function, a touch panel module 770 that performs a touch sensing function, etc., for example. In exemplary embodiments, the mobile device 700 may further include a global positioning system ("GPS") module, a microphone ("MIC") module, a speaker module, a gyroscope module, etc., for example. However, the functional modules 740, 750, 760, and 770 in the mobile device 700 are not limited thereto.

The power management device 780 may provide an operating voltage to the SoC 710, the memory device 720, the storage device 730 and the functional modules 740, 750, 760 and 770.

According to exemplary embodiments, the display module 760 includes the gamma circuit GMC 762 as described above. The gamma circuit 762 may reduce the color distortion of the low gray values and enhance the image quality by generating the minimum gamma reference voltage GRVc using the base gamma offset OFSb, the first gamma offset OFS1 and the second offset OFS2.

Figure 15:
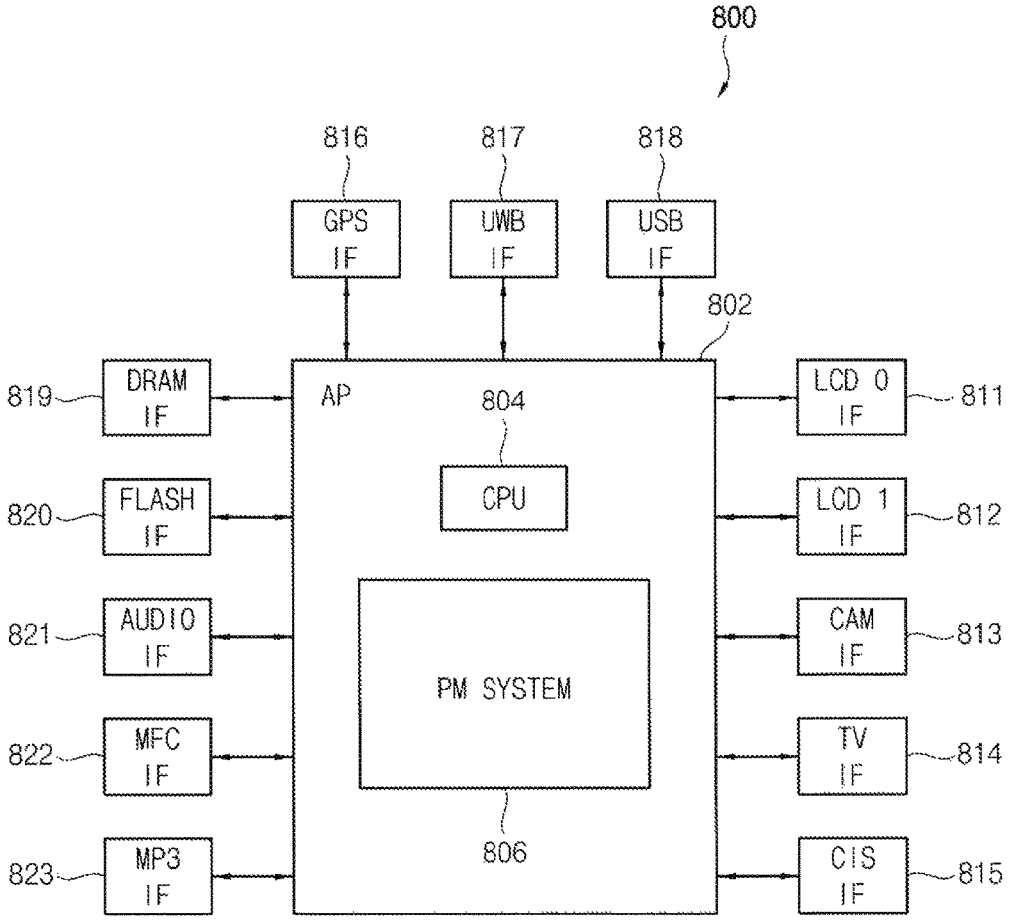
FIG. 15 is a block diagram illustrating exemplary embodiments of an interface included in a mobile device.

FIG. 15 is a block diagram illustrating an interface included in a mobile device according to exemplary embodiments.

Referring to FIG. 15, a mobile device 800 includes a SoC 802 and a plurality of interfaces 811, 812, 813, 814, 815, 816, 817, 818, 819, 820, 821, 822 and 823. According to exemplary embodiments, the mobile device 800 may be any mobile device, such as a mobile phone, a smart phone, a tablet computer, a laptop computer, a personal digital assistants ("PDA"), a portable multimedia player ("PMP"), a digital camera, a portable game console, a music player, a camcorder, a video player, a navigation system, etc.

The SoC 802 controls overall operations of the mobile device 800. In an exemplary embodiment, the SoC 802 may be an application processor ("AP") that is included in the mobile device 800, for example.

The SoC 802 may communicate with each of a plurality of peripheral devices (not illustrated) via each of the plurality of interfaces 811 to 823. In an exemplary embodiment, each of the interfaces 811 to 823 may transmit at least one control signal, which is output from a respective IP among a plurality of IPs implemented in each of power domains, to each of the plurality of peripheral devices, for example.

In an exemplary embodiment, the SoC 802 may control a power state and an operation state of each flat panel display device via each of display interfaces 811 and 812, for example. The flat panel display device may include a liquid crystal display ("LCD"), a light emitting diode ("LED") display, an organic light emitting diode ("OLED") display or an active matrix organic light-emitting diode ("AMOLED") display, etc., for example.

The SoC 802 may control a power state and an operation state of a camcorder via a camcorder interface 813, may control a power state and an operation state of a TV module via a TV interface 814, and may control a power state and an operation state of a camera module or an image sensor module via an image sensor interface 815.

The SoC 802 may control a power state and an operation state of a GPS module via a GPS interface 816, may control a power state and an operation state of a UWB module via a UWB interface 817, and may control a power state and an operation state of an universal serial bus ("USB") drive via a USB drive interface 818.

The SoC 802 may control a power state and an operation state of a DRAM via a DRAM interface 819, may control a power state and an operation state of a nonvolatile memory device (e.g., a flash memory) via a nonvolatile memory interface 820 (e.g., a flash memory interface), may control a power state and an operation state of an audio module through an audio interface 821, may control a power state of a multi-format codec ("MFC") through an MFC interface 822, and may control a power state of an MP3 player through an MP3 player interface 823. In an exemplary embodiment, a module or an interface may be implemented in hardware or software, for example.

Figure 16:
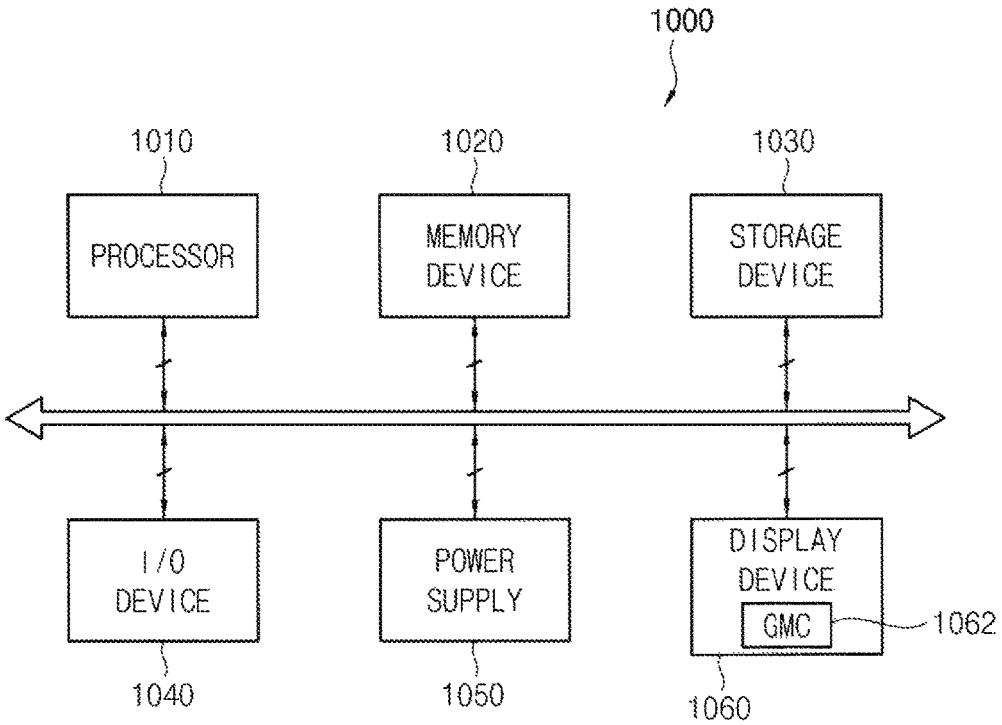
FIG. 16 is a block diagram illustrating an electronic device including exemplary embodiments of a display device.

FIG. 16 is a block diagram illustrating an electronic device including a display device according to exemplary embodiments.

Referring to FIG. 16, the electronic device 1000 may include a processor 1010, a memory device 1020, a storage device 1030, an input/output ("I/O") device 1040, a power supply 1050, and a display device 1060. The electronic device 1000 may further include a plurality of ports for communicating a video card, a sound card, a memory card, a universal serial bus ("USB") device, other electronic devices, etc.

The processor 1010 may perform various computing functions. The processor 1010 may be a micro-processor, a central processing unit ("CPU"), etc. In an exemplary embodiment, the processor 1010 may be coupled to other components via an address bus, a control bus, a data bus, etc. In an exemplary embodiment, the processor 1010 may be coupled to an extended bus, such as a peripheral component interconnection ("PCI") bus. The memory device 1020 may store data for operations of the electronic device 1000. In an exemplary embodiment, the memory device 1020 may include at least one non-volatile memory device, such as an EPROM device, an EEPROM device, a flash memory device, a PRAM device, a RRAM device, a NFGM device, a PoRAM device, a MRAM device, a FRAM device, etc., and/or at least one volatile memory device, such as a DRAM device, a SRAM device, a mobile DRAM device, etc. The storage device 1030 may be a SSD device, a HDD device, a CD-ROM device, etc.

In an exemplary embodiment, the I/O device 1040 may be an input device such as a keyboard, a keypad, a mouse, a touchpad, a touch-screen, a remote controller, etc., and an output device such as a printer, a speaker, etc. The power supply 1050 may provide a power for operations of the electronic device 1000. The display device 1060 may communicate with other components via the buses or other communication links.

According to exemplary embodiments, the display module 1060 includes the gamma circuit GMC 1062 as described above. The gamma circuit 1062 may reduce the color distortion of the low gray values and enhance the image quality by generating the minimum gamma reference voltage GRVc using the base gamma offset OFSb, the first gamma offset OFS1 and the second offset OFS2.

The above described embodiments may be applied to various kinds of devices and systems such as a mobile phone, a smart phone, a tablet computer, a laptop computer, a personal digital assistant ("PDA"), a portable multimedia player ("PMP"), a digital television, a digital camera, a portable game console, a music player, a camcorder, a video player, a navigation system, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A method of operating an electroluminescent display device, the method comprising:

determining a first gamma offset corresponding to a first gamma reference voltage by performing a multi-time programmable operation with respect to a first reference gray value;

determining a second gamma offset corresponding to a second gamma reference voltage by performing the multi-time programmable operation with respect to a second reference gray value greater than the first reference gray value;

determining a base gamma offset by performing the multi-time programmable operation with respect to a base reference gray value smaller than the first reference gray value; and generating low gray voltages corresponding to low gray values smaller than the first reference gray value based on the base gamma offset, the first gamma offset and the second gamma offset, wherein the generating the low gray voltages includes:

determining a slope factor representing a trend of the low gray voltages based on the base gamma offset, the first gamma offset and the second gamma offset.

2. The method of claim 1, wherein the low gray voltages are determined by performing an extrapolation of the first gamma reference voltage and the second gamma reference voltage using the slope factor as a weight value.

3. The method of claim 1, wherein the generating the low gray voltages further includes:

calculating a minimum gamma reference voltage corresponding to a minimum reference gray value smaller than the base reference gray value based on the slope factor, the first gamma reference voltage and the second gamma reference voltage.

4. The method of claim 3, wherein the generating the low gray voltages further includes:

generating the minimum gamma reference voltage based on a minimum gamma offset corresponding to the calculated minimum gamma reference voltage;

generating the first gamma reference voltage based on the first gamma offset; and generating the low gray voltages corresponding to the low gray values between the minimum reference gray value and the first reference gray value by linearly dividing the minimum gamma reference voltage and the first gamma reference voltage.

5. The method of claim 3, wherein the minimum reference gray value corresponds to a gray value of 1.

6. The method of claim 5, wherein a gray voltage corresponding to a gray value of 0 has a fixed voltage regardless of the multi-time programmable operation.

7. The method of claim 3, wherein the minimum reference gray value corresponds to a gray value of 0.

8. The method of claim 1, wherein the slope factor includes a red slope factor corresponding to red pixels, a green slope factor corresponding to green pixels and a blue slope factor corresponding to blue pixels.

9. The method of claim 8, wherein each of the red slope factor, the green slope factor and the blue slope factor includes a plurality of values corresponding to a plurality of temperature intervals.

10. The method of claim 8, wherein each of the red slope factor, the green slope factor and the blue slope factor includes a plurality of values corresponding to a plurality of dimming brightness intervals.

11. The method of claim 1, wherein the low gray values include at least one gray value smaller than the base reference gray value.

12. An electroluminescent display device comprising:

a display panel including a plurality of pixels connected to a plurality of data lines;

a gamma circuit which stores a plurality of gamma offsets corresponding to a plurality of gamma reference voltages, the plurality of gamma offsets being determined by performing a multi-time programmable operation with respect to a plurality of reference gray values, and which generates the gamma reference voltages based on the plurality of stored gamma offsets; and a data driver which generates a plurality of gray voltages based on the gamma reference voltages, and which drives the plurality of data lines based on image data and the gray voltages, wherein the electroluminescent display device generates low gray voltages corresponding to low gray values based on a first gamma offset corresponding to a first reference gray value, a second gamma offset corresponding to a second reference gray value greater than the first reference gray value and a base gamma offset corresponding to a base reference gray value smaller than the first reference gray value, the low gray values being smaller than the first reference gray value, and wherein the gamma circuit includes:

a calculation unit which determines a slope factor based on the base gamma offset, the first gamma offset and the second gamma offset, the slope factor representing a trend of the low gray voltages corresponding to the low gray values.

13. The electroluminescent display device of claim 12, wherein the gamma circuit further includes:

a storage unit which stores and provides the base gamma offset, the first gamma offset and the second gamma offset;

the calculation unit which calculates a minimum gamma reference voltage corresponding to a minimum reference gray value smaller than the base reference gray value based on the slope factor, a first gamma reference voltage corresponding to the first gamma offset and a second gamma reference voltage corresponding to the second gamma offset, and provides a minimum gamma offset corresponding to the calculated minimum gamma reference voltage; and a voltage generation block which generates the minimum gamma reference voltage, the first gamma reference voltage and the second gamma reference voltage based on the minimum gamma offset, the first gamma offset and the second gamma offset.

14. The electroluminescent display device of claim 13, wherein the data driver generates the low gray voltages corresponding to the low gray values between the minimum reference gray value and the first reference gray value by linearly dividing the minimum gamma reference voltage and the first gamma reference voltage.

15. The electroluminescent display device of claim 13, wherein the minimum reference gray value corresponds to a gray value of 1.

16. The electroluminescent display device of claim 15, wherein a gray voltage corresponding to a gray value of 0 has a fixed voltage regardless of the multi-time programmable operation.

17. The electroluminescent display device of claim 13, wherein the minimum reference gray value corresponds to a gray value of 0.

18. The electroluminescent display device of claim 13, wherein the slope factor includes a red slope factor corresponding to red pixels, a green slope factor corresponding to green pixels and a blue slope factor corresponding to blue pixels.

19. The electroluminescent display device of claim 18, wherein each of the red slope factor, the green slope factor and the blue slope factor includes a plurality of values corresponding to a plurality of temperature intervals.

20. The electroluminescent display device of claim 18, wherein each of the red slope factor, the green slope factor and the blue slope factor includes a plurality of values corresponding to a plurality of dimming brightness intervals.

* * * * *